US009850610B2

(12) United States Patent
Iida

(10) Patent No.: US 9,850,610 B2
(45) Date of Patent: Dec. 26, 2017

(54) HOLDER MEMBER

(71) Applicant: BROTHER KOGYO KABUSHIKI KAISHA, Nagoya-shi, Aichi-ken (JP)

(72) Inventor: Mitsuhiro Iida, Hashima-gun (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 226 days.

(21) Appl. No.: 14/636,633

(22) Filed: Mar. 3, 2015

(65) Prior Publication Data

US 2015/0259839 A1 Sep. 17, 2015

(30) Foreign Application Priority Data

Mar. 14, 2014 (JP) ..... 2014-051151

(51) Int. Cl.

| | |
|---|---|
| ***D05C 7/04*** | (2006.01) |
| ***D05B 81/00*** | (2006.01) |
| ***D05B 19/04*** | (2006.01) |
| ***D05B 19/02*** | (2006.01) |
| ***D05C 5/00*** | (2006.01) |
| ***D05C 9/04*** | (2006.01) |

(52) U.S. Cl.

CPC ..... *D05B 81/00* (2013.01); *D05B 19/02* (2013.01); *D05B 19/04* (2013.01); *D05C 5/00* (2013.01); *D05C 9/04* (2013.01)

(58) Field of Classification Search

CPC ..... D05C 9/04; D05B 81/00
USPC ..... 112/103
See application file for complete search history.

(56) References Cited

U.S. PATENT DOCUMENTS 5,222,314 A * 6/1993 Inteso ..... D05C 9/04 112/103
5,237,941 A * 8/1993 Kraft ..... D05C 9/04 112/103
5,291,843 A * 3/1994 Hori ..... D05B 3/243 112/103
5,992,339 A * 11/1999 Mack ..... D05C 9/04 112/103

(Continued)

FOREIGN PATENT DOCUMENTS

EP 2292824 A2 3/2011
EP 2 366 823 A2 9/2011

(Continued)

OTHER PUBLICATIONS

Aug. 27, 2015 Extended European Search Report issued in European Patent Application No. 15158901.7.

(Continued)

*Primary Examiner* — Nathan Durham
(74) *Attorney, Agent, or Firm* — Oliff PLC

(57) ABSTRACT

A holder member includes a planar portion, a mounting portion, a color reference member, and an affixing device. The planar portion has a surface that is planar. The mounting portion supports the planar portion. The mounting portion is also configured to be removably mounted on an embroidery frame moving mechanism of a sewing machine. The color reference member is provided on the planar portion. The color reference member also shows a color that serves as a reference. The affixing device is configured to fix in place an object that has been placed on the planar portion.

15 Claims, 16 Drawing Sheets

(56) References Cited

U.S. PATENT DOCUMENTS 6,095,068 A * 8/2000 Hori ..... D05C 9/04 112/103
6,298,800 B1 * 10/2001 Gala ..... D05C 9/04 112/103
6,775,934 B1 * 8/2004 Gallik ..... D05C 9/04 112/103
6,901,870 B2 * 6/2005 Eklof ..... D05C 9/12 112/103
7,155,302 B2 * 12/2006 Muto ..... D05B 19/08 700/138
7,418,771 B2 * 9/2008 Hori ..... D05C 9/04 112/103
7,484,466 B2 2/2009 Kuki et al.
8,539,892 B2 * 9/2013 Tokura ..... D05B 19/12 112/102.5
8,606,390 B2 12/2013 Hjalmarsson et al.
2005/0229830 A1 * 10/2005 Hori ..... D05C 9/04 112/103
2006/0272565 A1 * 12/2006 Bowlus ..... D05C 9/04 112/103
2007/0227420 A1 10/2007 Suzuki et al.
2007/0233310 A1 10/2007 Yamada
2008/0092791 A1 * 4/2008 Surget ..... D05C 9/04 112/103
2008/0103624 A1 5/2008 Yamada
2008/0202399 A1 * 8/2008 Mack ..... D05C 9/04 112/103
2009/0188413 A1 7/2009 Hirata et al.
2009/0188414 A1 * 7/2009 Tokura ..... D05B 19/10 112/457
2009/0217850 A1 9/2009 Tokura
2009/0267277 A1 * 10/2009 Mack ..... B25B 11/002 269/8
2011/0048301 A1 * 3/2011 Tokura ..... D05B 19/12 112/103
2011/0113999 A1 * 5/2011 Widell ..... D05C 7/08 112/103
2012/0090519 A1 * 4/2012 Fukao ..... D05C 9/04 112/103
2012/0209417 A1 8/2012 Tokura
2013/0247806 A1 * 9/2013 Gardner ..... D05C 9/04 112/475.01
2014/0230706 A1 * 8/2014 Suzuki ..... D05B 19/12 112/102.5
2014/0230707 A1 8/2014 Suzuki et al.
2015/0059632 A1 * 3/2015 Amakawa ..... D05C 9/04 112/103

FOREIGN PATENT DOCUMENTS

JP H07-265569 A 10/1995
JP 2005-146460 A 6/2005
JP 2009-201704 A 9/2009

OTHER PUBLICATIONS

Jul. 22, 2015 Extended Search Report issued in European Patent Application No. 15158900.9.
U.S. Appl. No. 14/636,739, filed Mar. 3, 2015 in the name of Masashi Tokura.
U.S. Appl. No. 14/805,794, filed Jul. 22, 2015 in the name of Masashi Tokura.

* cited by examiner

HOLDER MEMBER

CROSS-REFERENCE TO RELATED APPLICATION

This Application claims priority to Japanese Patent Application No. 2014-051151, filed on Mar. 14, 2014, the content of which is hereby incorporated by reference.

BACKGROUND

The present disclosure relates to a holder member that can be used on a sewing machine that is provided with an embroidery frame moving mechanism.

A sewing machine that is provided with an image capture device is known. In the sewing machine, an embroidery frame that holds a sewing workpiece is mounted on an embroidery frame moving mechanism of the sewing machine. The image capture device captures an image of the sewing workpiece that is held by the embroidery frame and creates image data. The image (the captured image) that is described by the created image data is used for a background image when an embroidery pattern is positioned and edited. The captured image is also used in processing that creates embroidery data for sewing the embroidery pattern.

SUMMARY

With the known embroidery frame, sufficient consideration has not been given to the capturing, by the image capture means with which the sewing machine is provided, of an image of an object that is held by the embroidery frame.

Various embodiments of the broad principles derived herein provide a holder member that is removably mounted on one of the embroidery frame and the embroidery frame moving mechanism of the sewing machine, the holder member holding an object and being suited to the capturing of an image of the object by an image capture means of the sewing machine.

A holder member according to a first aspect of the present disclosure includes a planar portion, a mounting portion, a color reference member, and an affixing device. The planar portion has a surface that is planar. The mounting portion supports the planar portion and is configured to be removably mounted on an embroidery frame moving mechanism of a sewing machine. The color reference member is provided on the planar portion and shows a color that serves as a reference. The affixing device is configured to fix in place an object that has been placed on the planar portion.

A holder member according to a second aspect of the present disclosure includes a planar portion, an engaging portion, a color reference member, and an affixing device. The planar portion has a surface that is planar. The engaging portion is provided in the planar portion. The engaging portion is also capable of engaging with an embroidery frame that a sewing machine holds. The color reference member is provided on the planar portion and shows a color that serves as a reference. The affixing device is configured to fix in place an object that has been placed on the planar portion.

A holder member according to a third aspect of the present disclosure includes a planar portion, a mounting portion, and a color reference member. The planar portion has a surface that is planar. In at least a portion of the surface, the planar portion includes a drawing area in which drawing is able to be done by a writing instrument. The mounting portion supports the planar portion. The mounting portion is also configured to be removably mounted on an embroidery frame moving mechanism of a sewing machine. The color reference member is provided on the planar portion. The color reference member also shows a color that serves as a reference.

BRIEF DESCRIPTION OF THE DRAWINGS

Embodiments will be described below in detail with reference to the accompanying drawings in which.

DETAILED DESCRIPTION

Figure 1:
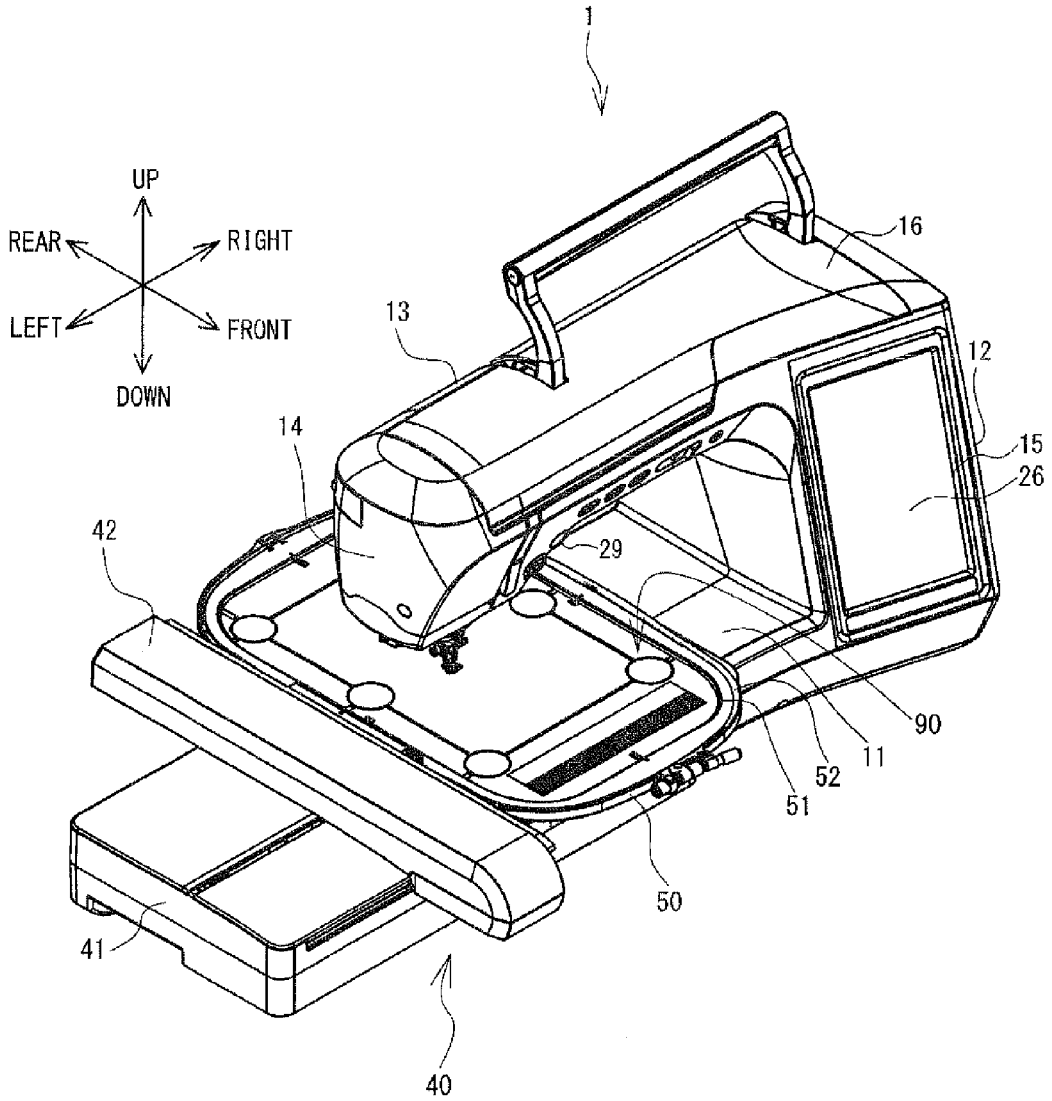
FIG. 1 is an oblique view of a sewing machine 1.

Hereinafter, embodiments will be explained with reference to the drawings. Note that the drawings are used for explaining technological features that the present disclosure can utilize. Accordingly, device configurations, flowcharts for various types of processing, and the like that are shown in the drawings are merely explanatory examples and do not serve to restrict the present disclosure to those configurations, flowcharts, and the like, unless otherwise indicated specifically. A physical configuration of a sewing machine 1 will be explained with reference to FIGS. 1 to 3. The up-down direction, the lower right side, the upper left side, the lower left side, and the upper right side in FIGS. 1 and 2 respectively define the up-down direction, the front side, the rear side, the left side, and the right side of the sewing machine 1. That is, the face of the sewing machine 1 on which is disposed a liquid crystal display 15, which will be described later, is the front face of the sewing machine 1. Lengthwise directions of a bed 11 and an arm 13 are equivalent to the left-right direction of the sewing machine 1, and the side of the sewing machine 1 on which a pillar 12 is disposed is the right side. The direction in which the pillar 12 extends is the up-down direction of the sewing machine 1.

Figure 2:
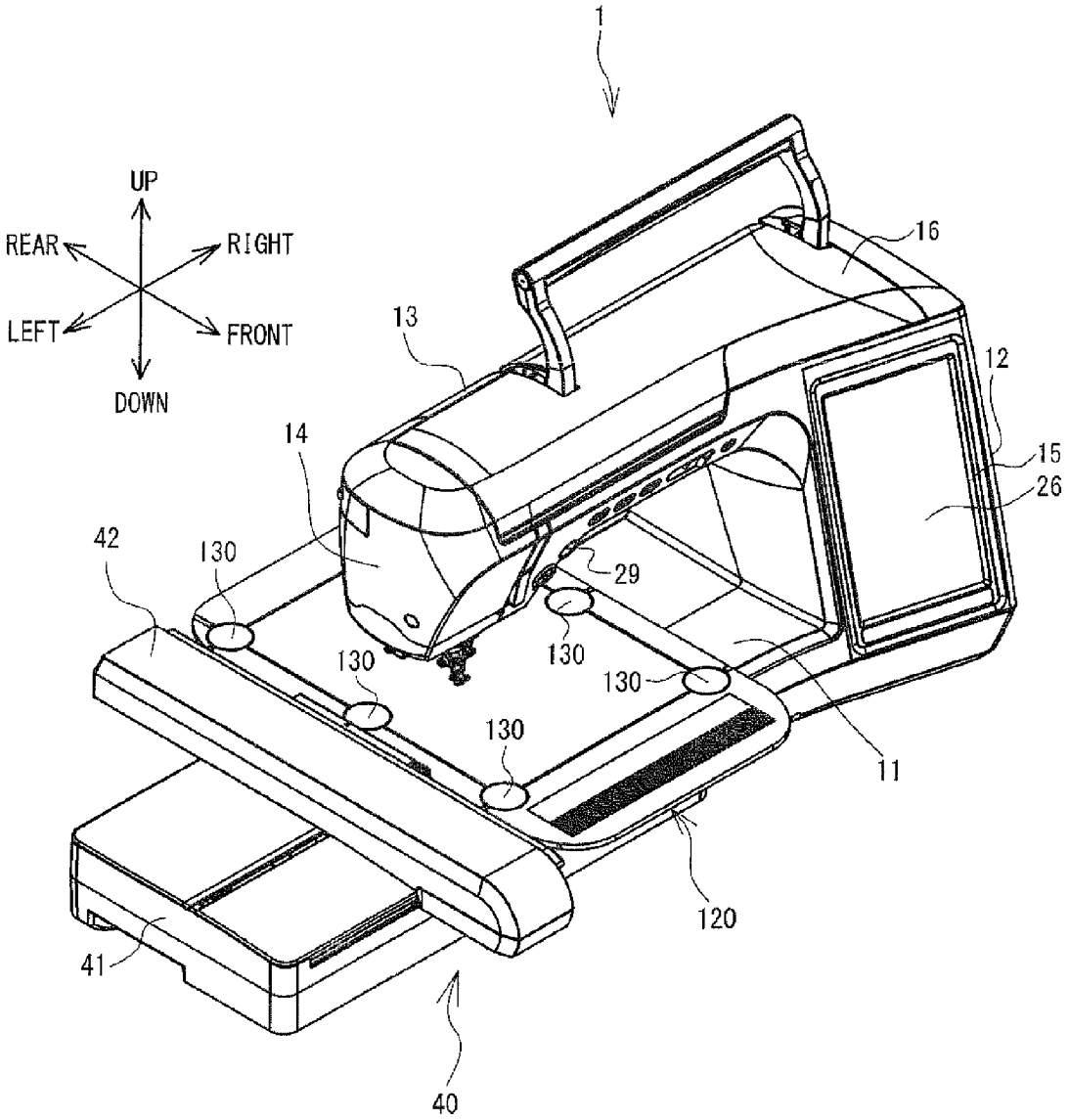
FIG. 2 is an oblique view of the sewing machine 1.

As shown in FIGS. 1 and 2, the sewing machine 1 is provided with the bed 11, the pillar 12, the arm 13, and a head 14. The bed 11 is the base portion of the sewing machine 1 and extends in the left-right direction. The pillar 12 is provided such that it extends upward from the right end of the bed 11. The arm 13 extends to the left from the upper end of the pillar 12 and faces the bed 11. The head 14 is a component that is coupled to the left end of the arm 13.

The bed 11 is provided with a needle plate 21 (refer to FIG. 3) on its top face. The needle plate 21 includes a needle hole (not shown in the drawings). Underneath the needle plate 21 (that is, inside the bed 11), the sewing machine 1 is provided with a feed dog, a feed mechanism, a shuttle mechanism, and the like that are not shown in the drawings. During ordinary sewing that is not embroidery sewing, the feed dog is driven by the feed mechanism and moves a sewing workpiece (for example, a work cloth) by a specified feed amount. The shuttle mechanism entwines an upper thread (not shown in the drawings) with a lower thread (not shown in the drawings) below the needle plate 21.

The sewing machine 1 is also provided with an embroidery frame moving mechanism (hereinafter called the moving mechanism) 40. The moving mechanism 40 is capable of being mounted on and removed from the bed 11 of the sewing machine 1. FIGS. 1 and 2 show a state in which the moving mechanism 40 has been mounted on the sewing machine 1. When the moving mechanism 40 is mounted on the sewing machine 1, the moving mechanism 40 and the sewing machine 1 are electrically connected. The moving mechanism 40 is provided with a body portion 41 and a carriage 42. The carriage 42 is provided on the top side of the body portion 41. The carriage 42 has a rectangular shape whose long axis extends in the front-rear direction. The carriage 42 is provided with a frame holder (not shown in the drawings), a Y axis moving mechanism (not shown in the drawings), and a Y axis motor 84 (refer to FIG. 16). The frame holder is provided on the right side face of the carriage 42. One embroidery frame or one holder member that has been selected from among a plurality of types of embroidery frames and holder members of different sizes and shapes can be mounted on the frame holder. The plurality of types of the embroidery frames and holder members will be described later. The Y axis moving mechanism moves the frame holder in the front-rear direction (the Y axis direction). The Y axis motor 84 drives the Y axis moving mechanism.

The body portion 41 is provided with an X axis moving mechanism (not shown in the drawings) and an X axis motor 83 (refer to FIG. 16) in its interior. The X axis moving mechanism moves the carriage 42 in the left-right direction (the X axis direction). The X axis motor 83 drives the X axis moving mechanism. The moving mechanism 40 is capable of moving the one of the embroidery frame and the holder member that is mounted on the carriage 42 (the frame holder) to a position that is indicated by an XY coordinate system (an embroidery coordinate system) that is specific to the sewing machine 1. In the embroidery coordinate system, for example, the rightward direction, the leftward direction, the forward direction, and the rearward direction in the sewing machine 1 are equivalent to a positive X axis direction, a negative X axis direction, a negative Y axis direction, and a positive Y axis direction.

The liquid crystal display (hereinafter called the LCD) 15 is provided on the front face of the pillar 12. An image that includes various types of items, such as commands, illustrations, setting values, messages, and the like, is displayed on the LCD 15. A touch panel 26 that can detect a pressed position is provided on the front face of the LCD 15. When a user uses a finger or a stylus pen (not shown in the drawings) to perform a pressing operation on the touch panel 26, the pressed position is detected by the touch panel 26. Based on the pressed position that was detected, a CPU 61 of the sewing machine 1 (refer to FIG. 16) recognizes the item in the image that was selected. Hereinafter, the pressing operation on the touch panel 26 by the user will be called a panel operation. By performing a panel operation, the user can select a pattern to be sewn, a command to be executed, and the like. The pillar 12 is provided with a sewing machine motor 81 (refer to FIG. 16) in its interior.

A cover 16 that can be opened and closed is provided in the upper part of the arm 13. The cover 16 is in a closed state in FIGS. 1 and 2. A spool containing portion (not shown in the drawings) is provided under the cover 16, that is, in the interior of the arm 13. The spool containing portion is able to contain a thread spool (not shown in the drawings) on which the upper thread is wound. A drive shaft (not shown in the drawings) that extends in the left-right direction is provided in the interior of the arm 13. The drive shaft is rotationally driven by the sewing machine motor 81. Various types of switches that include a start/stop switch 29 are provided in the lower left portion of the front face of the arm 13. The start/stop switch 29 starts and stops operation of the sewing machine 1, that is, it is used for inputting commands to start and stop sewing.

Figure 3:
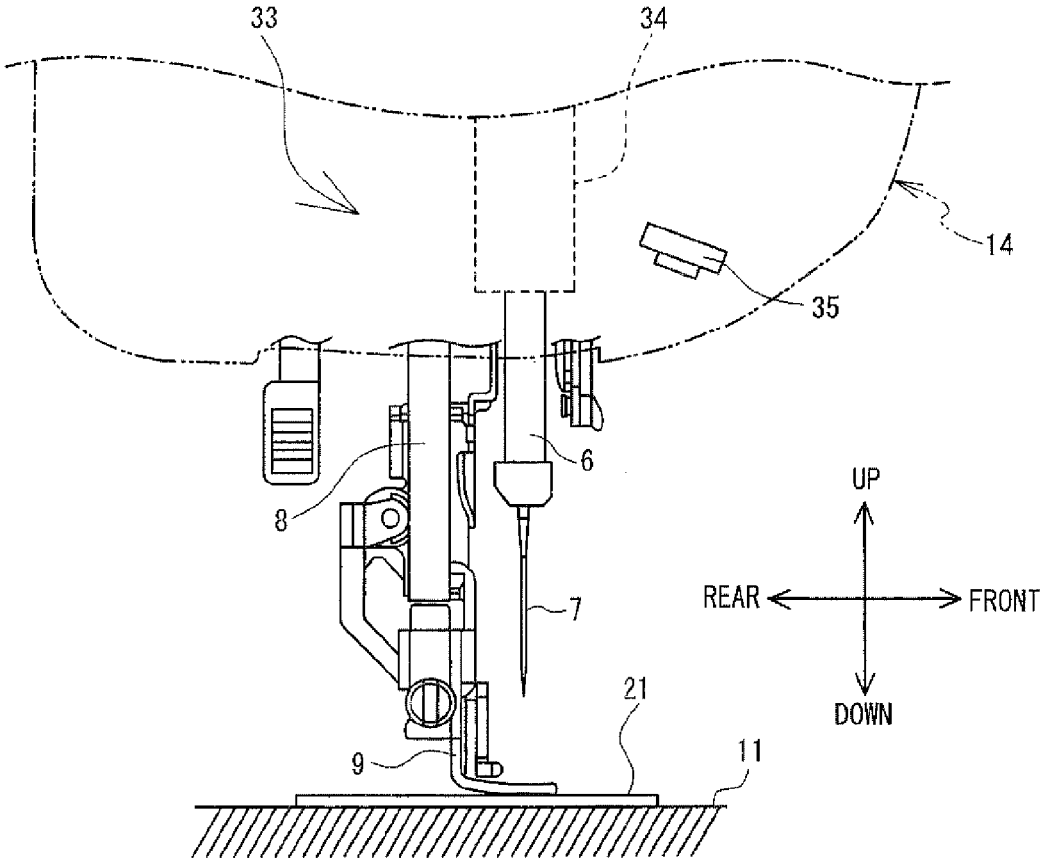
FIG. 3 is an explanatory figure that shows a configuration of a lower end portion of a head 14.

As shown in FIG. 3, a needle bar 6, a presser bar 8, a needle bar up-down drive mechanism 34, and the like are provided in the head 14. The needle bar 6 and the presser bar 8 extend downward from a lower end portion of the head 14. The sewing needle 7 is removably mounted on the lower end of the needle bar 6. A presser foot 9 is removably attached to the lower end of the presser bar 8. The needle bar 6 is provided on lower end of the needle bar up-down drive mechanism 34. The needle bar up-down drive mechanism 34 drives the needle bar 6 up and down in accordance with the rotation of the drive shaft. The needle bar 6, the needle bar up-down drive mechanism 34, and the sewing machine motor 81 (refer to FIG. 16) are provided in the sewing machine 1 as a sewing portion 33.

An image sensor 35 is provided in the interior of the head 14. The image sensor 35 is a known complementary metal oxide semiconductor (CMOS) image sensor, for example. The image sensor 35 is disposed such that it can capture an image of an area that includes the area below the needle bar 6, and it is capable of creating image data. The image data that the image sensor 35 outputs are stored in a specified storage area of a RAM 63 (refer to FIG. 16). The relationship between a coordinate system for the image that is described by the image data that the image sensor 35 has created and a coordinate system for the whole of space (hereinafter called the world coordinate system) is established in advance by parameters that are stored in a flash memory 64. The relationship between the world coordinate system and the embroidery coordinate system is established in advance by parameters that are stored in the flash memory 64 (refer to FIG. 16). Accordingly, the sewing machine 1 is capable of performing processing that specifies coordinates in the embroidery coordinate system based on the image data.

The image sensor 35 in the present embodiment has a function that creates the image data with the white balance corrected. More specifically, the image sensor 35 has an auto white balance function (hereinafter called the AWB) and a manual white balance function (hereinafter called the MWB). The AWB is a function that performs color temperature correction on the image data using determined white balance values (hereinafter called determined WB values) that are determined based on color information in the image data. The MWB is a function that performs color temperature correction on the image data using set white balance values (hereinafter called set WB values). The set WB values are white balance values (hereinafter called WB values) that are set by the CPU 61, which will be described later. The color information is information that describes color. In the present embodiment, the color information is expressed in the form of gradation values (numerical values from 0 to 255) for the three primary colors red (R), green (G), and blue (B).

The plurality of types of the embroidery frames and holder members that can be mounted on the moving mechanism 40 will be explained. The embroidery frame includes a first frame member and a second frame member, and it can hold the sewing workpiece using the first frame member and the second frame member. Each one of the first frame member and the second frame member is a frame-shaped member. The embroidery frame is configured such that stitches can be formed by the sewing portion 33 in a sewing-enabled area that is defined on the inner side the embroidery frame. The holder member includes a planar portion that has a surface that is planar, and the holder member is capable of holding an object that has been placed on the planar portion. The object may be, for example, an object of image capture by the image sensor 35.

Figure 5:
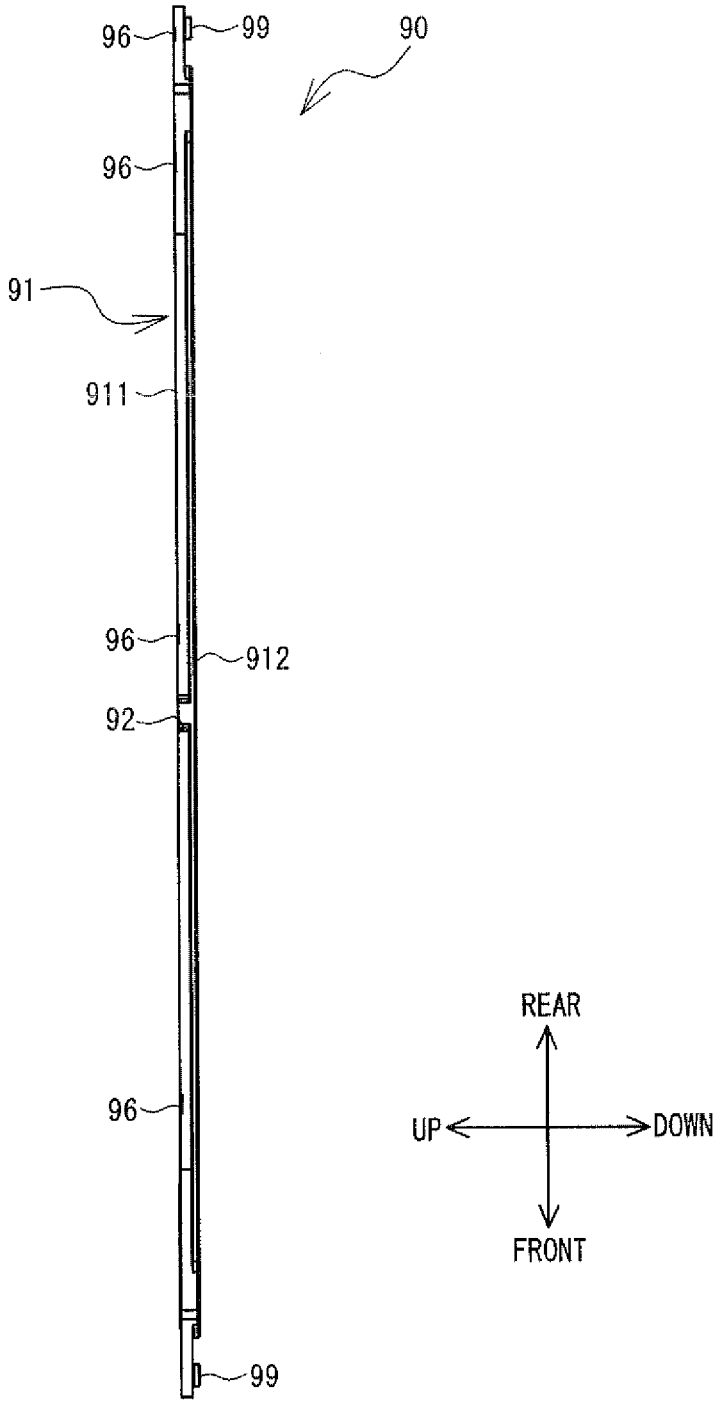
FIG. 5 is a right side view of the holder plate 90.
Figure 6:
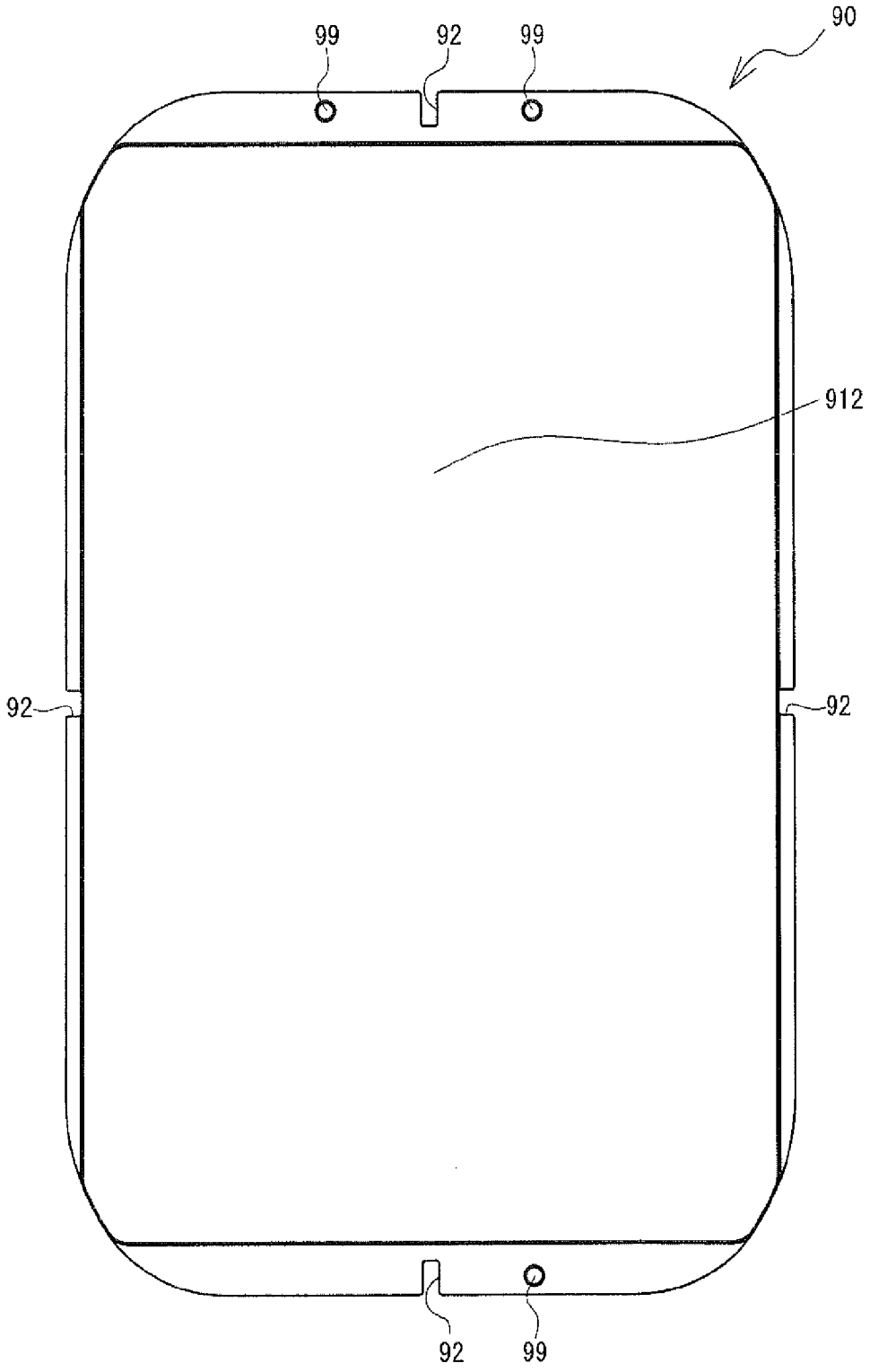
FIG. 6 is a bottom view of the holder plate 90.
Figure 7:
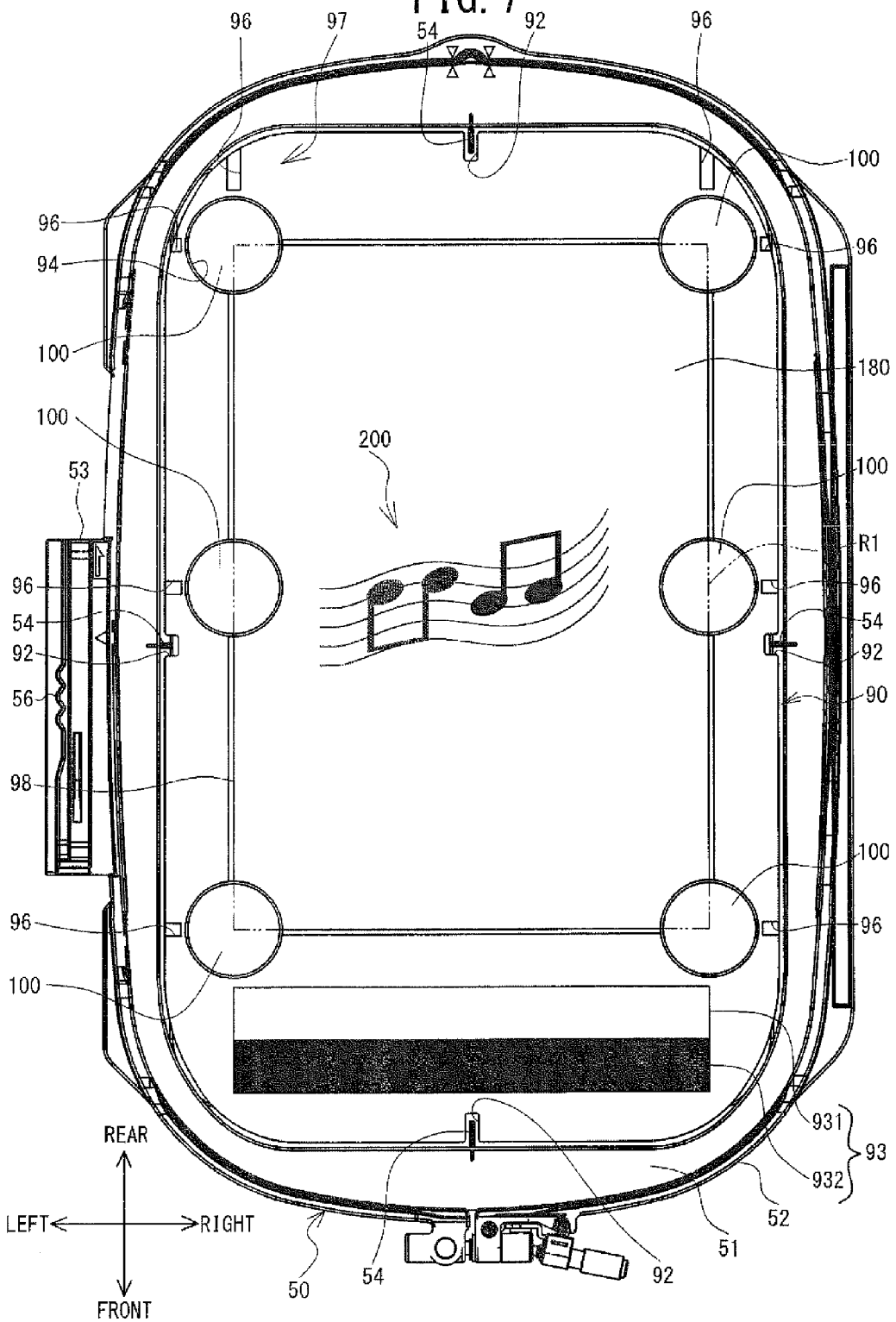
FIG. 7 is a plan view of an embroidery frame 50 to which the holder plate 90 has been attached.
Figure 8:
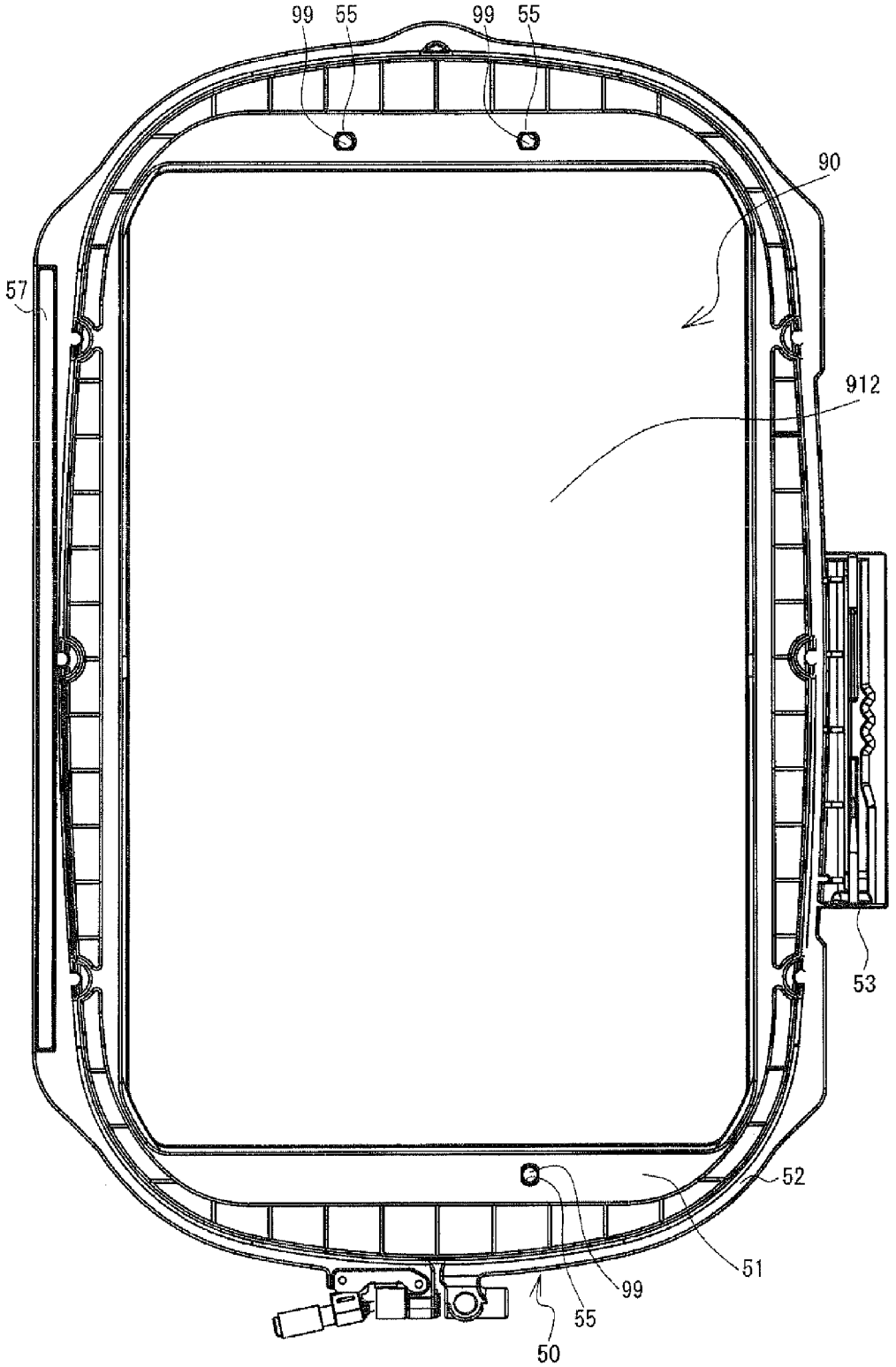
FIG. 8 is a bottom view of the embroidery frame 50 to which the holder plate 90 has been attached.

An embroidery frame 50 that can be mounted on the moving mechanism 40 and a holder plate 90 that can be mounted on the embroidery frame 50 will be explained with reference to FIG. 1 and FIGS. 4 to 8. The left-right direction, the top side, and the bottom side in FIGS. 4 and 7 respectively define the left-right direction, the rear side, and the front side of the embroidery frame 50 and the holder plate 90. The holder plate 90 is a rectangular plate member whose long axis extends in the front-rear direction in a plan view. In other words, the short side direction of the holder plate 90 is the left-right direction. The long side direction of the holder plate 90 is the front-rear direction of the holder plate 90. The side of the holder plate 90 on which a color reference member 93 that will be described later is provided is the front side of the holder plate 90. The embroidery frame 50 of which an example is shown in FIG. 1 includes an inner frame 51 and an outer frame 52 and is an embroidery frame of a known configuration that holds the sewing workpiece (not shown in the drawings) by using the inner frame 51 and the outer frame 52 to clamp it. As shown in FIGS. 7 and 8, the embroidery frame 50 is provided with a mounting portion 53, four engaging portions 54, and three engagement holes 55. The mounting portion 53 is configured such that it can be removably mounted on the moving mechanism 40 of the sewing machine 1. In the present embodiment, a detected portion 56 is provided on the mounting portion 53, as shown in FIG. 7. The detected portion 56 has a shape that is particular to the type of the embroidery frame 50. In a case where the embroidery frame 50 is mounted on the moving mechanism 40, the sewing machine 1 is able to specify the type of the embroidery frame 50 based on the shape of the detected portion 56 of the mounting portion 53, which is detected by a detector 36 (refer to FIG. 16) that will be described later. The four engaging portions 54 and the three engagement holes 55 engage with the holder plate 90 that is mounted on the embroidery frame 50.

Figure 4:
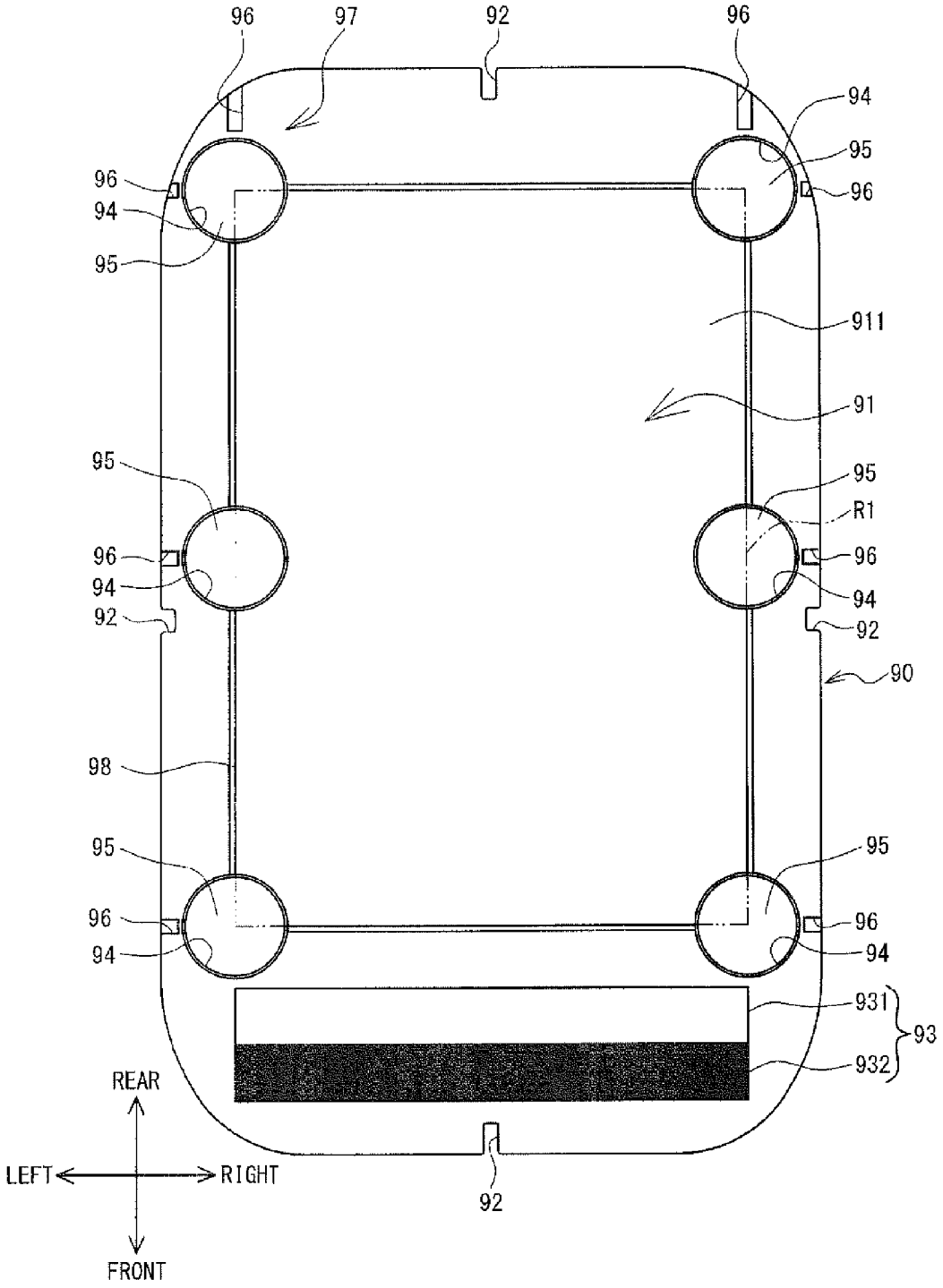
FIG. 4 is a plan view of a holder plate 90.

As shown in FIGS. 1, 7, and 8, the holder plate 90 can be mounted on the embroidery frame 50. The holder plate 90 is used in a case where an image of a sheet-shaped object, for example, will be captured by the image sensor 35. The sheet-shaped object may be a paper, a work cloth, or a resin sheet, for example. As shown in FIGS. 4 to 6, the holder plate 90 is mainly provided with a planar portion 91, four engaging portions 92, three engaging portions 99, the color reference member 93, six magnetic bodies 95, an indicator portion 97, a base line 98, and six magnets 100 (refer to FIG. 7). To facilitate the explanation, the magnets 100 are not shown in FIGS. 4 and 5. The planar portion 91 has a surface 911 that is planar. As shown in FIGS. 5 and 6, the planar portion 91 in the present embodiment has a surface 912 that is also planar on the opposite side from the surface 911. The four engaging portions 92 and the three engaging portions 99 are able to engage with the embroidery frame 50 that is mounted on the sewing machine 1. More specifically, the four engaging portions 92 are notches that are provided in central portions of each of the four sides of the rectangular holder plate 90 and that extend toward the center of the holder plate 90. Each one of the three engaging portions 99 is a protruding portion that is circular in a bottom view and that projects downward from the bottom face of the holder plate 90. Two of the three engaging portions 99 are provided on the front side of the bottom face of the holder plate 90, and one of the three engaging portions 99 is provided on the rear side of the bottom face of the holder plate 90.

The color reference member 93 is a member that serves as a color reference. The color reference member 93 includes a white color reference member 931 that serves as a reference for the color white and a black color reference member 932 that serves as a reference for the color black. In the present embodiment, each one of the white color reference member 931 and the black color reference member 932 is a known reflective plate whose surface is planar. The color reference member 93 may be formed by printing coatings of the specified colors on the planar portion 91, and may also be formed by affixing to the planar portion 91 a reflective tape material of the specified colors. Each one of the white color reference member 931 and the black color reference member 932 lies on the same plane as the surface 911 of the planar portion 91 and is positioned to the outside of an image capture object range R1. More specifically, each one of the white color reference member 931 and the black color reference member 932 is provided such that it extends in the short side direction (the left-right direction) of the holder plate 90 at one end (the front end) of the holder plate 90 in the long side direction. Each one of the white color reference member 931 and the black color reference member 932 is provided within an image capture enabled range for the image sensor 35. The image capture enabled range for the image sensor 35 is determined by an image capture range of the image sensor 35, a movement enabled range for the moving mechanism 40, the size of the embroidery frame or the holder member, and the like. The image capture object range R1 is a rectangular range that is the object of image capture by the image sensor 35 and is the range that is indicated by dashed-two dotted lines in FIGS. 4 and 7. The image capture object range R1 includes the center portion of the surface 911 of the planar portion 91. In the present embodiment, the image capture object range R1 is set by the sewing machine 1 within the image capture enabled range for the image sensor 35, in accordance with the types of the embroidery frame and the holder member, based on data that are stored in the flash memory 64.

In the present embodiment, each one of the white color reference member 931 and the black color reference member 932 is rectangular, with a smaller surface area than that of the image capture object range R1, and they are disposed adjacent to one another. The lengths of the white color reference member 931 and the black color reference member 932 in the long side direction (the left-right direction) are the same as the length of the image capture object range R1 in the short side direction (the left-right direction). Furthermore, the lengths of the white color reference member 931 and the black color reference member 932 in the short side direction (the front-rear direction) are lengths that are set by taking into consideration the image capture range of the image sensor 35.

Each one of the six magnetic bodies 95 is an iron plate that is circular in a plan view. Each of the magnetic bodies 95 is disposed inside a recessed portion 94 that is provided in the surface 911 and is circular in a plan view, and is embedded in the planar portion 91. In other words, the top face of each of the magnetic bodies 95 is either even with the surface 911 or slightly below the surface 911 and does not protrude above the surface 911. In the present embodiment, each one of the six magnetic bodies 95 is disposed in a position that coincides with a portion of the boundary of the image capture object range R1 within the surface 911 of the planar portion 91. Four of the six magnetic bodies 95 are disposed at the four corners of the rectangular image capture object range R1. The remaining two of the six magnetic bodies 95 are disposed in the centers of the two long sides of the rectangular image capture object range R1. As shown in FIG. 7, the holder plate 90 is provided with the six magnets 100, which correspond to the individual magnetic bodies 95. A sheet-shaped object, such as a rectangular paper 180 on which a FIG. 200 is drawn, for example, can be affixed to the holder plate 90 by the six sets of the magnetic bodies 95 and the magnets 100. That is, the six sets of the magnetic bodies 95 and the magnets 100 are configured to affix an object that has been placed on the planar portion 91.

The indicator portion 97 is provided in at least the perimeter portion of the planar portion 91. In the present embodiment, the indicator portion 97 includes eight indicators 96 that are positioned to the outside of the magnetic bodies 95 (in the same plane as the surface 911 and farther from the center of the holder plate 90 than are the magnetic bodies 95). Each one of the indicators 96 indicates the positions of the magnetic bodies 95 that are embedded in the planar portion 91. Two of the eight indicators 96 are recessed portions that are provided such that they extend from one edge (the rear edge) toward the other edge (the front edge) in the long side direction of the holder plate 90, and they indicate the positions of the magnetic bodies 95 in the long side direction of the holder plate 90. Three of the eight indicators 96 are recessed portions that are provided such that they extend from one edge (the left edge) toward the other edge (the right edge) in the short side direction of the holder plate 90, and they indicate the positions of the magnetic bodies 95 in the short side direction of the holder plate 90. Three of the eight indicators 96 are recessed portions that are provided such that they extend from one edge (the right edge) toward the other edge (the left edge) in the short side direction of the holder plate 90, and they indicate the positions of the magnetic bodies 95 in the short side direction of the holder plate 90. Because the indicator portion 97 is positioned to the outside of the magnetic bodies 95, cases occur in which, depending on the size of the sheet-shaped object, the indicator portion 97 is not covered by the sheet-shaped object, even if the magnetic bodies 95 are covered by the sheet-shaped object. In these cases, the user is able to specify the positions of the six magnetic bodies 95 based on the positions of the indicators 96 that indicate the positions in the short side direction of the holder plate 90 and on the positions of the indicators 96 that indicate the positions in the long side direction of the holder plate 90.

The base line 98 is a guide for placing an object on the surface 911 of the planar portion 91. In the present embodiment, the base line 98 is a straight line segment that extends along the outline of the image capture object range R1.

As shown in FIG. 7, when the holder plate 90 has been mounted on the embroidery frame 50, the four engaging portions 92 engage with the corresponding four protruding engaging portions 54 of the embroidery frame 50. As shown in FIG. 8, when the holder plate 90 has been mounted on the embroidery frame 50, the three engaging portions 99 engage with the corresponding three engagement holes 55 of the embroidery frame 50, which are through-holes in the up-down direction and are circular in a bottom view. The holder plate 90 is positioned in relation to the embroidery frame 50 and locked in place by these engagements. When the embroidery frame 50 on which the holder plate 90 has been mounted is mounted on the moving mechanism 40, the surface 911 of the holder plate 90 is approximately parallel to the bed 11. The planar portion 91 is disposed on the top side of the needle plate 21 and below the needle bar 6 and the presser foot 9. Furthermore, as shown in FIG. 8, a rectangular sliding sheet 57 whose long axis extends in the long side direction of the embroidery frame 50 is provided on the underside of the right edge of the outer frame 52 of the embroidery frame 50. The sliding sheet 57 is a sheet member that has been processed to give its surface a low coefficient of friction. The sliding sheet 57 is provided such that it protrudes slightly from the surface of the underside of the outer frame 52. The amount that the sliding sheet 57 protrudes is determined by taking into consideration the distance between the embroidery frame 50, which is mounted on the moving mechanism 40, and one of the bed 11 and the needle plate 21. Therefore, when the embroidery frame 50 has been mounted on the moving mechanism 40, the sliding sheet 57 is in a state of contact with the top face of the one of the bed 11 and the needle plate 21. When the embroidery frame 50 has been mounted on the moving mechanism 40, one long side of the embroidery frame 50 is supported by the mounting portion 53, and the other long side of the embroidery frame 50 is supported by the sliding sheet 57. The embroidery frame 50 can more easily keep horizontal the surface of the planar portion 91 that is mounted on the embroidery frame 50 than would be possible if the sliding sheet 57 were not provided on the embroidery frame 50. When the moving mechanism 40 moves the embroidery frame 50, the moving mechanism 40 is able to move the embroidery frame 50 smoothly in a state of low friction resistance, because the sliding sheet 57 moves while in contact with the top face of the one of the bed 11 and the needle plate 21.

Figure 9:
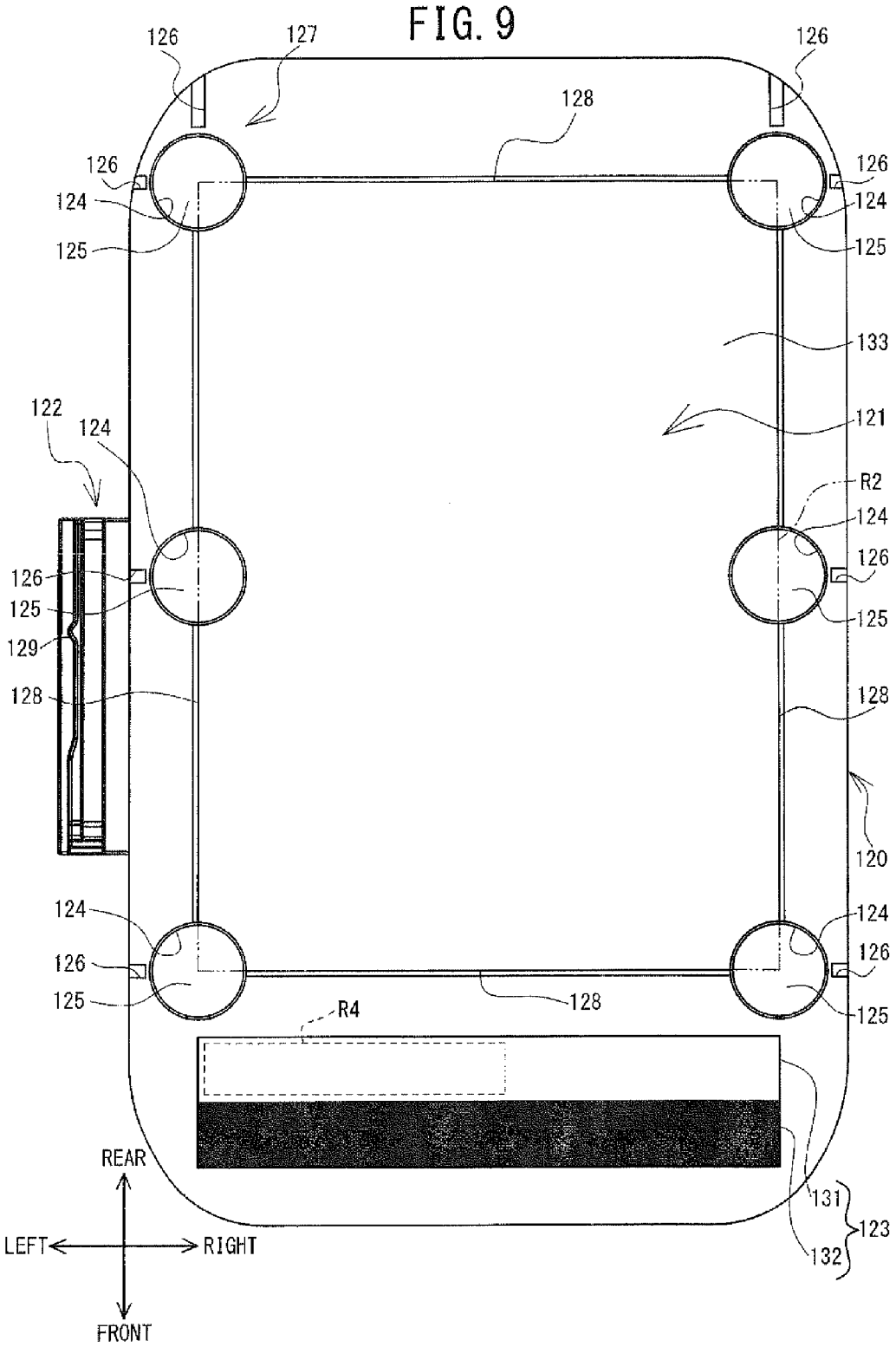
FIG. 9 is a plan view of a holder member 120.
Figure 10:
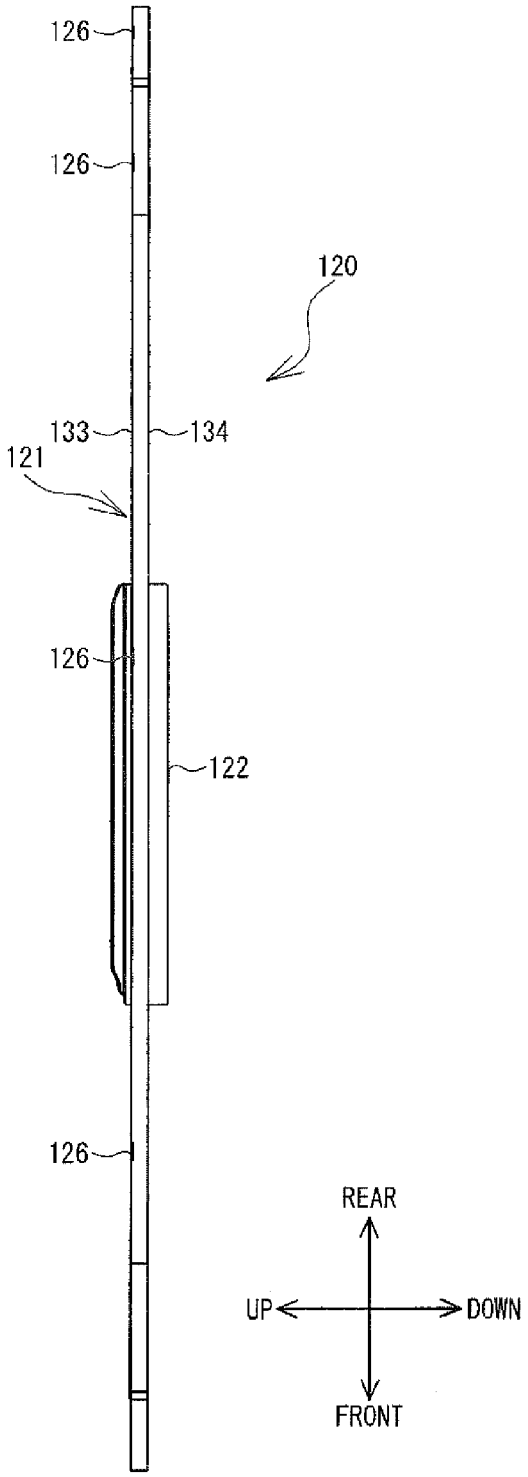
FIG. 10 is a right side view of the holder member 120.
Figure 11:
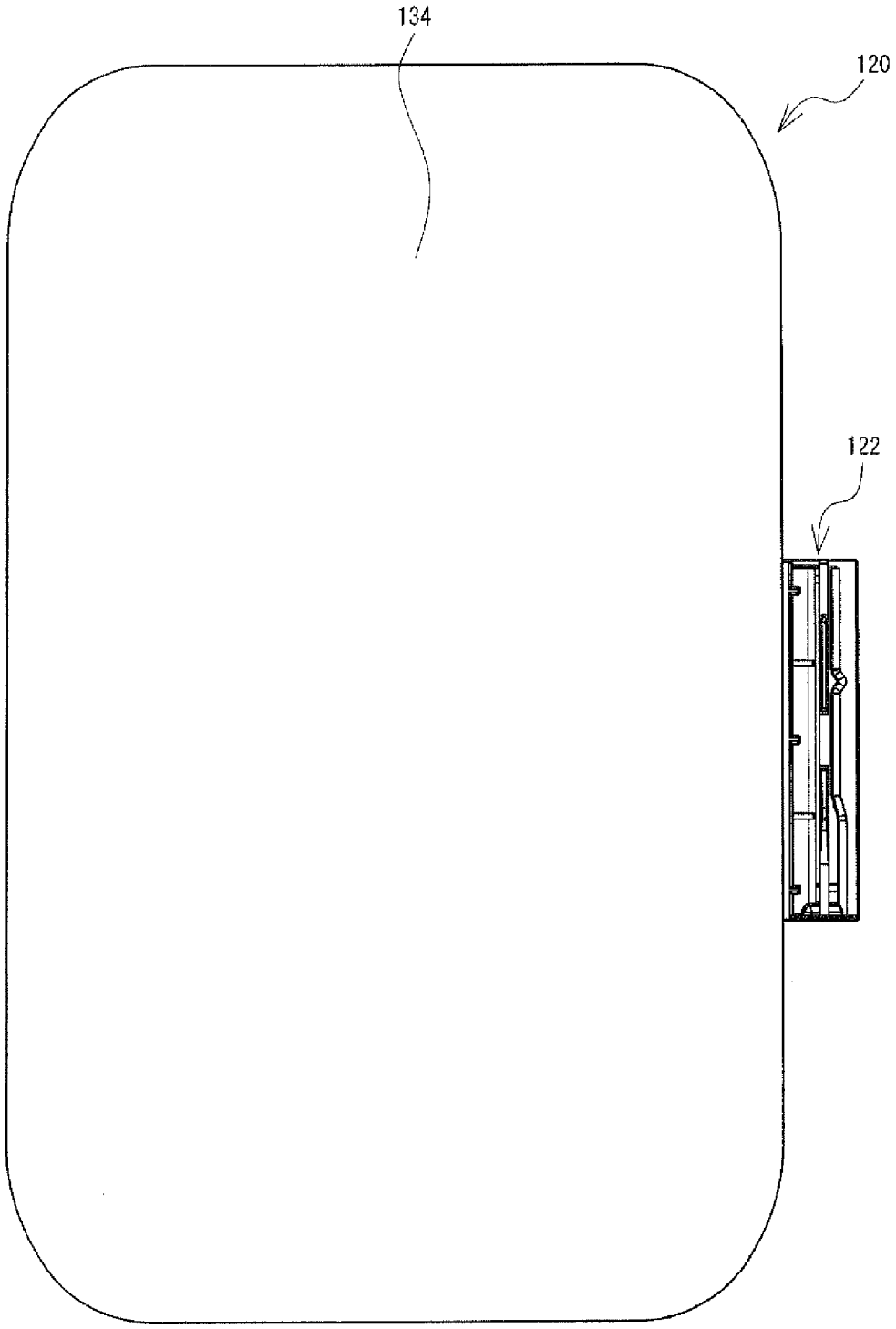
FIG. 11 is a bottom view of the holder member 120.
Figure 12:
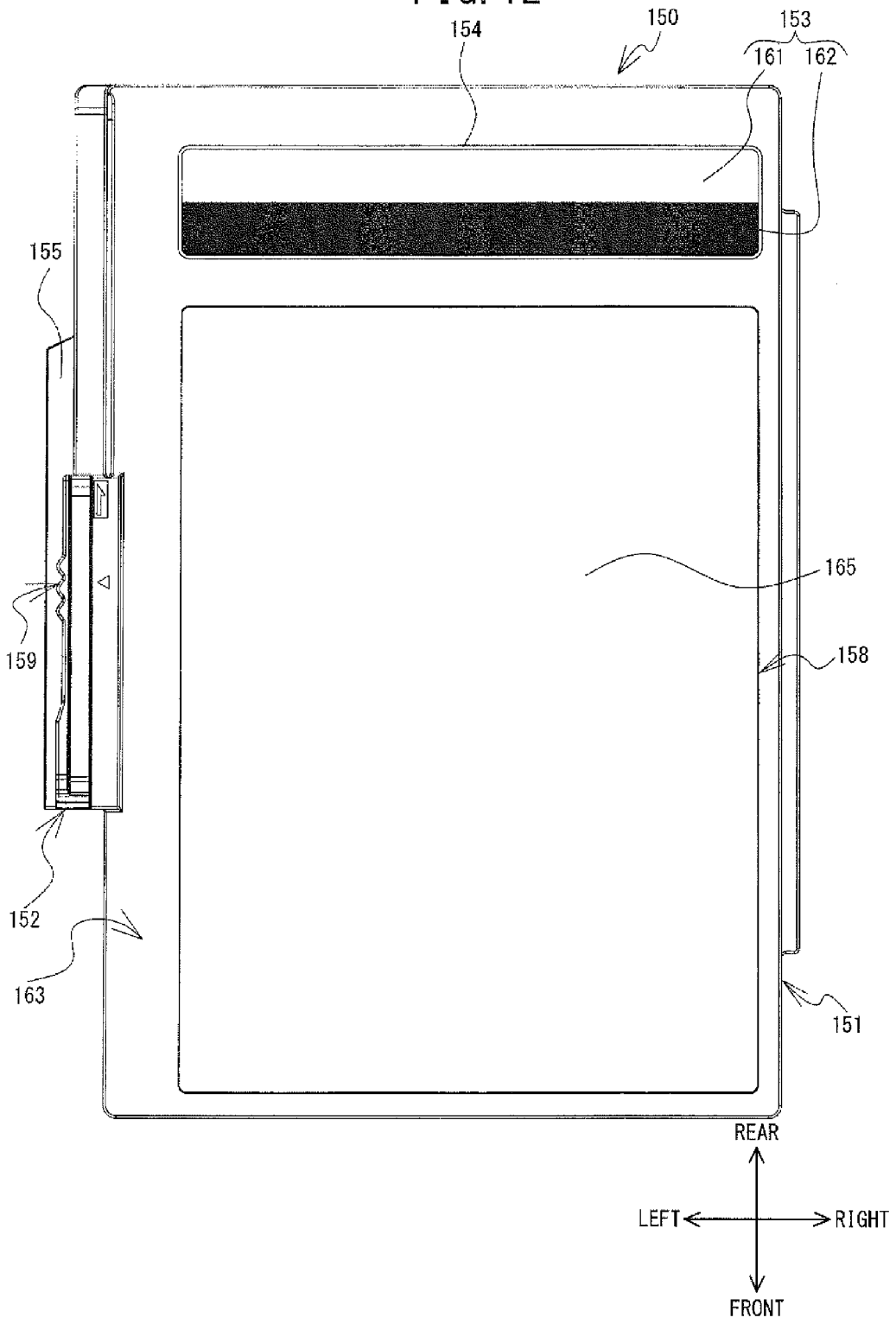
FIG. 12 is a plan view of a holder member 150.

A holder member 120 that can be mounted on the moving mechanism 40 will be explained with reference to FIGS. 9 to 11. The left-right direction, the top side, and the bottom side in FIG. 9 respectively define the left-right direction, the rear side, and the front side of the holder member 120. The holder member 120 is a rectangular plate member whose long axis extends in the front-rear direction in a plan view. In other words, the short side direction of the holder member 120 is the left-right direction. The side of the holder member 120 on which a mounting portion 122 that will be described later is provided is the left side of the holder member 120. The long side direction of the holder member 120 is the front-rear direction of the holder member 120. The side of the holder member 120 on which a color reference member 123 that will be described later is provided is the front side of the holder member 120. The holder member 120 of which an example is shown in FIGS. 9 to 11 is used in a case where an image of a sheet-shaped object, for example, will be captured by the image sensor 35. The configuration of the holder member 120 is similar to the configuration of the holder plate 90, so explanations of elements that are the same will be simplified. Note that the configuration of the holder member 120 omits the sliding sheet on the underside.

As shown in FIGS. 9 to 11, the holder member 120 is mainly provided with a planar portion 121, the mounting portion 122, the color reference member 123, six magnetic bodies 125, an indicator portion 127, a base line 128, and six magnets 130 (refer to FIG. 2). The planar portion 121 has a surface 133 that is planar and has a rectangular shape in a plan view. As shown in FIGS. 10 and 11, the planar portion 121 in the present embodiment has a surface 134 that is also planar on the opposite side from the surface 133. The mounting portion 122 is provided approximately in the center of one long side (the left side) of the perimeter portion of the planar portion 121 and is a rectangular component in a plan view whose long axis extends in the long side direction of the planar portion 121. The mounting portion 122 supports the planar portion 121 and is configured such that it can be removably mounted on the moving mechanism 40 of the sewing machine 1. In the present embodiment, a detected portion 129 is provided on the mounting portion 122. The detected portion 129 has a shape that is particular to the type of the holder member 120 and that is different from the shape of the detected portion 56 that is provided on the mounting portion 53 of the embroidery frame 50. Therefore, when the holder member 120 has been mounted on the moving mechanism 40, the sewing machine 1 is able to specify that the holder member 120 has been mounted, based on the shape of the detected portion 129 that is detected by the detector 36, which will be described later.

The color reference member 123 is a member that serves as a color reference. The color reference member 123 is located in the perimeter portion of the planar portion 121, at one end of the holder member 120 in the long side direction, to the outside (on the front side) of an image capture object range R2, which is bounded by the base line 128. In the same manner as the color reference member 93, the color reference member 123 includes a white color reference member 131 that serves as a reference for the color white and a black color reference member 132 that serves as a reference for the color black. The lengths of the white color reference member 131 and the black color reference member 132 in the long side direction (the left-right direction) are the same as the length of the image capture object range R2 in the short side direction. Furthermore, the lengths of the white color reference member 131 and the black color reference member 132 in the short side direction (the front-rear direction) are lengths that are set by taking into consideration the image capture range of the image sensor 35.

Each one of the six magnetic bodies 125 is an iron plate that is circular in a plan view. In the same manner as the magnetic bodies 95, each of the magnetic bodies 125 is embedded inside a recessed portion 124 that is provided in the surface 133 and is circular in a plan view. The holder member 120 is provided with the six magnets 130 (refer to FIG. 2), which respectively correspond to the magnetic bodies 125. A sheet-shaped object can be affixed to the holder member 120 by the six sets of the magnetic bodies 125 and the magnets 130. In other words, the six sets of the magnetic bodies 125 and the magnets 130 are configured such that they fix in place an object that is placed on the planar portion 121.

The indicator portion 127 is provided in at least the perimeter portion of the planar portion 121. In the same manner as the indicator portion 97, the indicator portion 127 is provided with eight indicators 126. Each one of the eight indicators 126 indicates the positions of the magnetic bodies 125 that are embedded in the planar portion 121.

The base line 128 is a guide for placing an object on the surface 133 of the planar portion 121. In the present embodiment, the base line 128 is a straight line segment that extends along the outline of the rectangular image capture object range R2. When the holder member 120 has been mounted on the moving mechanism 40, the surface 133 of the holder member 120 is approximately parallel to the bed 11. The planar portion 121 is disposed on the top side of the needle plate 21 and below the needle bar 6 and the presser foot 9.

A holder member 150 that can be mounted on the moving mechanism 40 will be explained with reference to FIGS. 12 to 15. The left-right direction, the top side, and the bottom side in FIG. 12 respectively define the left-right direction, the rear side, and the front side of the holder member 150. The holder member 150 is a rectangular plate member whose long axis extends in the front-rear direction in a plan view. In other words, the short side direction of the holder member 150 is the left-right direction. The side of the holder member 150 on which a mounting portion 152 that will be described later is provided is the left side. The long side direction of the holder member 150 is the front-rear direction of the holder member 150. The side of the holder member 150 on which a color reference member 153 that will be described later is provided is the rear side. The holder member 150 of which an example is shown in FIGS. 12 to 15 is used in a case where an image of a sheet-shaped object, for example, will be captured by the image sensor 35. The configuration of the holder member 150 is similar to the configurations of the holder plate 90 and the holder member 120, so explanations of elements that are similar will be simplified.

Figure 13:
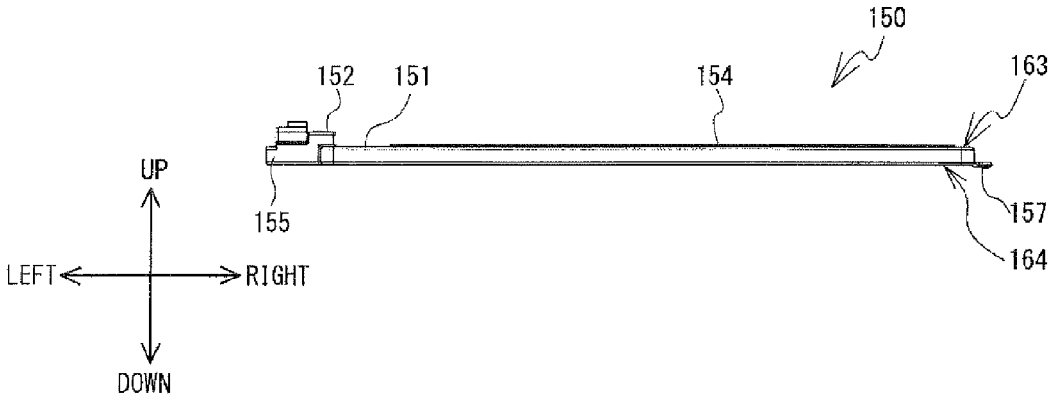
FIG. 13 is a front view of the holder member 150.
Figure 14:
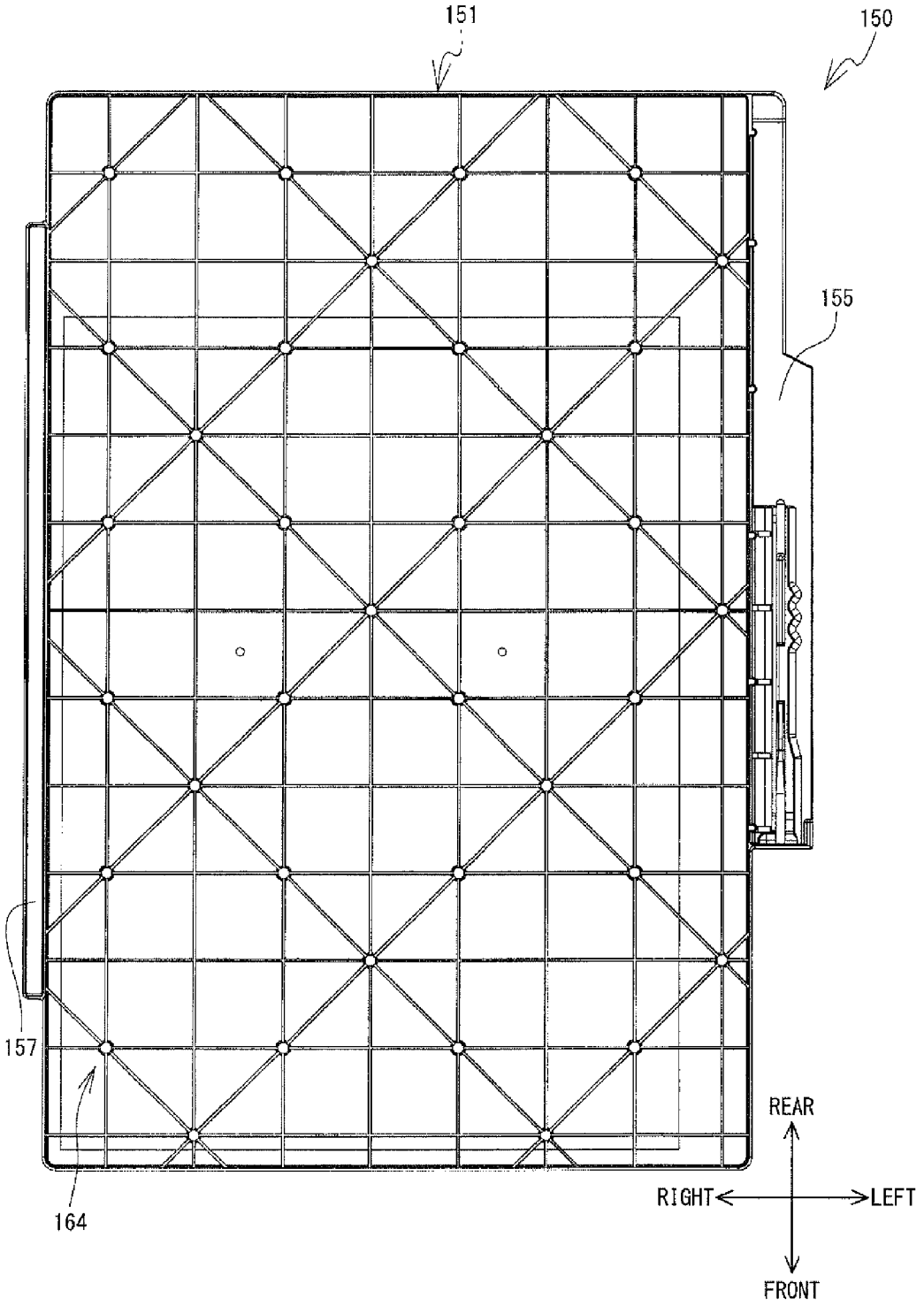
FIG. 14 is a bottom view of the holder member 150.
Figure 15:
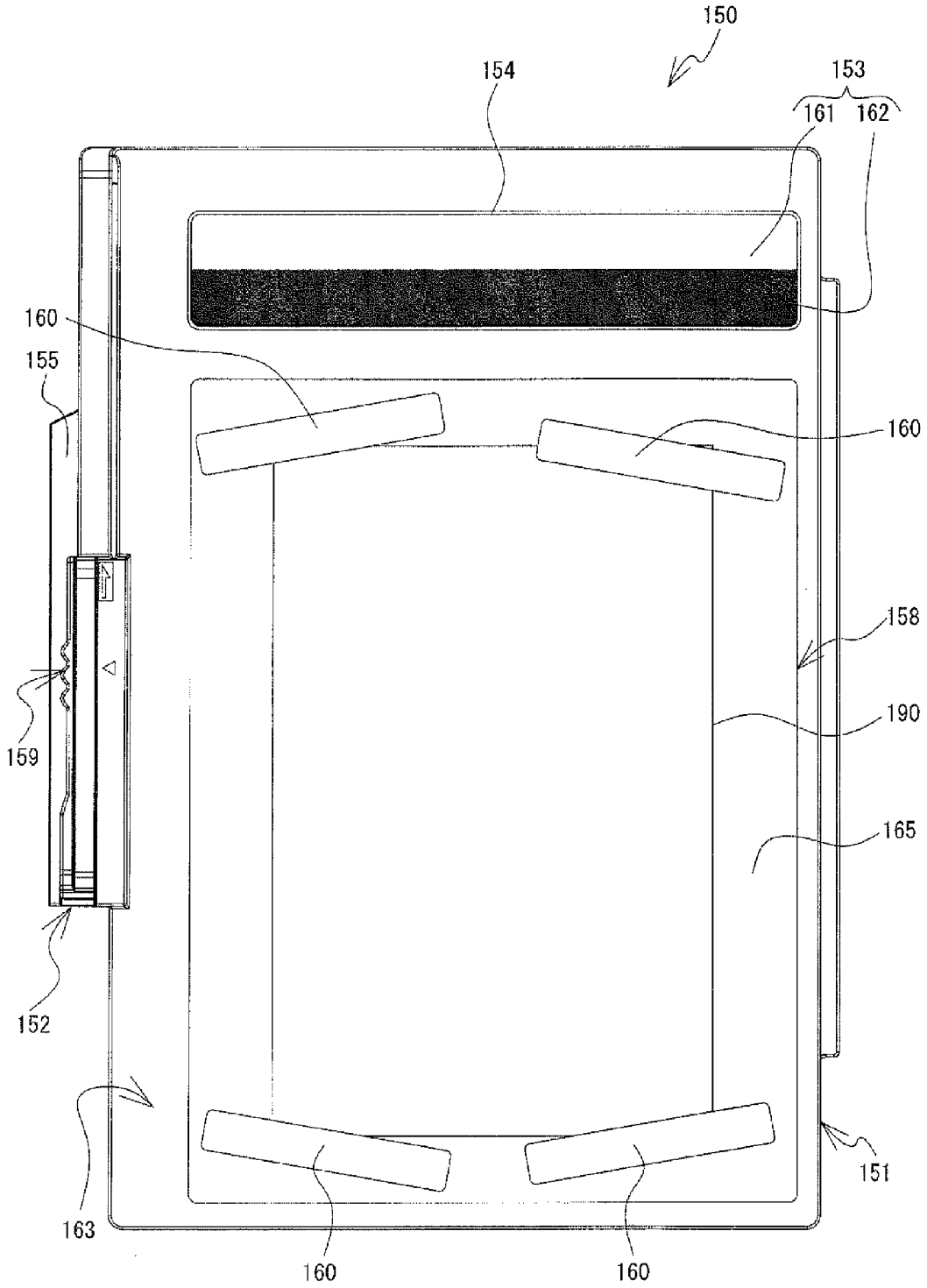
FIG. 15 is a plan view of the holder member 150 in a state in which a paper 190 is affixed to it.

As shown in FIGS. 12 to 15, the holder member 150 is mainly provided with a planar portion 151, the mounting portion 152, a protective plate 155, the color reference member 153, a raised portion 154, and four magnets 160 (refer to FIG. 15). The planar portion 151, the mounting portion 152, the protective plate 155, and the raised portion 154 are formed as a single unit from a resin material. The planar portion 151 has a surface 163 that is planar and is rectangular in a plan view. A drawing area 158 is an area that is rectangular in a plan view and includes a center portion of the surface 163. The drawing area 158 is formed by a plate 165 that is made of a magnetic material (for example, iron). The plate 165 has been given a surface treatment that makes it possible to do at least one of drawing with a writing instrument (for example, a special pen) and erasing with an erasing instrument. Specifically, the surface of the plate 165 is a whiteboard that has been coated with a fluorine resin, for example. The user is able to perform drawing with a writing instrument and erasing with an erasing instrument in the drawing area 158 of the plate 165. The drawing area 158 is congruent with an image capture object range that is set in a case where the holder member 150 is mounted on the sewing machine 1. A recessed portion (not shown in the drawings) with which the plate 165 engages is formed in the planar portion 151. The depth of the recessed portion is approximately equal to the thickness of the plate 165. The back face of the plate 165 adheres to the recessed portion of the planar portion 151, affixing the plate 165 to the planar portion 151. Furthermore, as shown in FIG. 14, a plurality of reinforcing ribs are formed in a lattice pattern on the back face of the planar portion 151.

The mounting portion 152 is provided approximately in the center of one long side of the perimeter portion of the planar portion 151 and is a rectangular component in a plan view whose long axis extends in the long side direction of the planar portion 151. The mounting portion 152 supports the planar portion 151 and is configured such that it can be removably mounted on the moving mechanism 40 of the sewing machine 1. A detected portion 159 is provided on the mounting portion 152. The detected portion 159 has a shape that is particular to the type of the holder member 150. Therefore, when the holder member 150 has been mounted on the moving mechanism 40, the sewing machine 1 is able to specify that the holder member 150 has been mounted, based on the shape of the detected portion 159 that is detected by the detector 36, which will be described later.

The protective plate 155 is a component that is provided in order to prevent the holder member 150 from being mounted by mistake on a sewing machine that is not provided with the image sensor 35. The protective plate 155 is a component that protrudes from the outer edge of the mounting portion 152, parallel to the surface 163 of the planar portion 151. Specifically, the protective plate 155 includes a portion that extends farther to the left than the left edge of the mounting portion 152 and a portion that extends farther to the rear than the rear edge of the mounting portion 152. When the user mounts the holder member 150 on a sewing machine, the user moves the mounting portion 152 of the holder member 150 toward the rear from a state in which the holder member 150 is disposed in front of the sewing machine, inserting the mounting portion 152 into the right side face of a moving mechanism of the sewing machine. The holder member 150 is configured such that, in a case where the user tries to mount the holder member 150 on a sewing machine that is not provided with the image sensor 35, the protective plate 155 interferes with the moving mechanism of the sewing machine, and the mounting portion 152 cannot be inserted into the moving mechanism. In contrast, in a case where the user mounts the holder member 150 on the sewing machine 1 of the present embodiment, which is provided with the image sensor 35, the protective plate 155 does not interfere with the moving mechanism 40, and the mounting portion 152 can be inserted into the moving mechanism 40.

The color reference member 153 is a member that serves as a color reference. The color reference member 153 is located in the perimeter portion of the planar portion 151, at one end of the holder member 150 in the long side direction, to the outside (on the rear side) of the drawing area 158. In the same manner as the color reference member 93, the color reference member 153 includes a white color reference member 161 that serves as a reference for the color white and a black color reference member 162 that serves as a reference for the color black. The white color reference member 161 and the black color reference member 162 are each rectangular in a plan view, and their lengths in the long side direction (the left-right direction) are the same as the length of an image capture object range R3 in the short side direction. The lengths of the white color reference member 161 and the black color reference member 162 in the short side direction (the front-rear direction) are lengths that are set by taking into consideration the image capture range of the image sensor 35.

The raised portion 154 is provided on the planar portion 151 and protrudes higher than the surface of the color reference member 153 in at least a portion of the perimeter of the color reference member 153. The raised portion 154 surrounds the entire perimeter of the color reference member 153 at a specified width (for example, one millimeter). The height of the raised portion 154 may be one millimeter, for example.

As shown in FIG. 15, each of the four magnets 160 is a thin plate-shaped magnet that is rectangular in a plan view. The sticking of the magnets 160 to the plate 165 makes it possible for a sheet-shaped object such as a paper 190, for example, to be affixed to the holder member 150. In other words, the four magnets 160 and the plate 165 are configured to fix in place an object that is placed in the drawing area 158 (the image capture object range) of the planar portion 151. Because the magnets 160 are disposed in the drawing area 158, it is preferable for the thicknesses of the magnets 160 to be such that the magnets 160 will not interfere with the presser foot 9 when the holder member 150 is moved by the moving mechanism 40. It is therefore preferable for the thicknesses of the magnets 160 to be fairly thin, such as one millimeter, for example. The sizes of the individual magnets 160 are set as desired by taking into consideration the shape, the size, and the like of the plate 165, and may be 90 millimeters by 15 millimeters, for example.

When the holder member 150 has been mounted on the moving mechanism 40, the surface 163 of the holder member 150 is approximately parallel to the bed 11. The planar portion 151 is disposed on the top side of the needle plate 21 and below the needle bar 6 and the presser foot 9. As shown in FIGS. 13 and 14, a rectangular sliding sheet 157 whose long axis extends in the long side direction of the holder member 150 is provided on the right edge of a back face 164 of the holder member 150. The sliding sheet 157 is a sheet member that has been processed to give its surface a low coefficient of friction. The sliding sheet 157 is provided such that it protrudes slightly from the surface of the underside of the holder member 150. The amount that the sliding sheet 157 protrudes is determined by taking into consideration the distance between the holder member 150 and one of the bed 11 and the needle plate 21. When the holder member 150 has been mounted on the moving mechanism 40, the sliding sheet 157 is in a state of contact with the top face of the one of the bed 11 and the needle plate 21. When the holder member 150 has been mounted on the moving mechanism 40, one edge of the holder member 150 in the long side direction is supported by the mounting portion 152, and the other edge of the holder member 150 in the long side direction is supported by the sliding sheet 157. The holder member 150 can more easily keep horizontal the surface 163 of the planar portion 151 than would be possible if the sliding sheet 157 were not provided on the holder member 150. When the moving mechanism 40 moves the holder member 150, the moving mechanism 40 is able to move the holder member 150 smoothly in a state of low friction resistance, because the sliding sheet 157 moves while in contact with the top face of one of the bed 11 and the needle plate 21.

Figure 16:
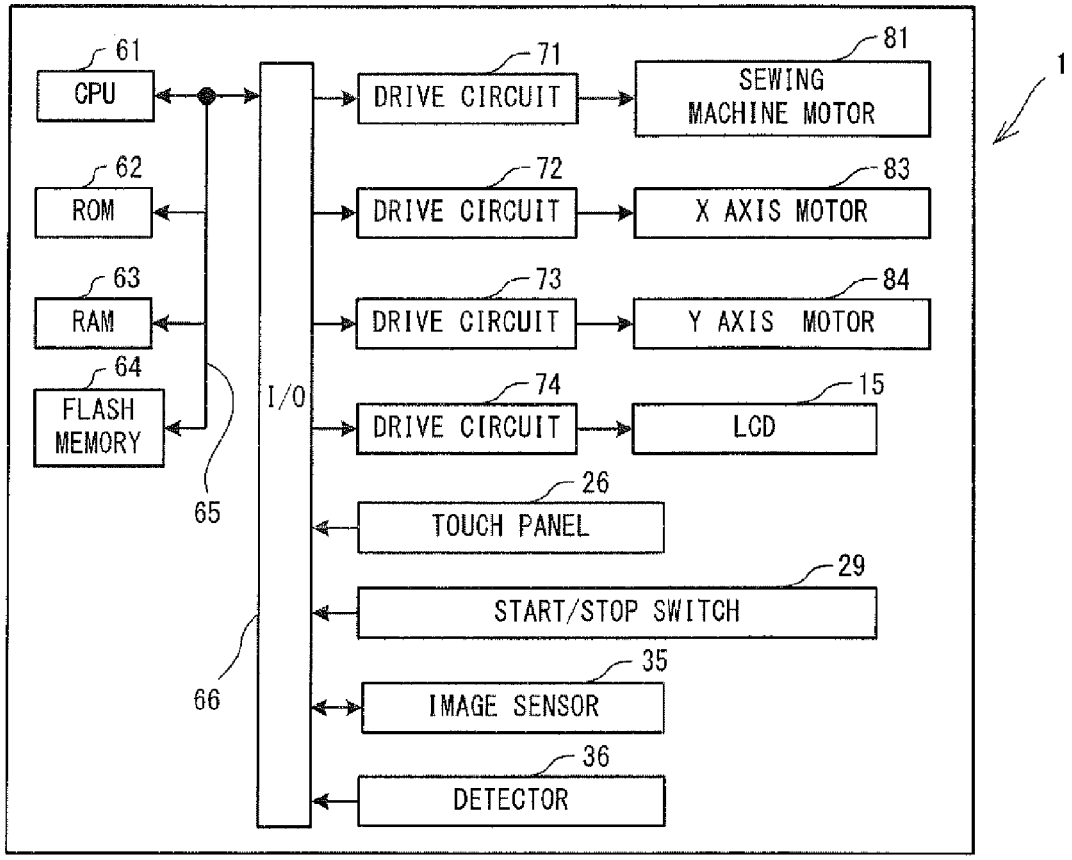
FIG. 16 is a block diagram of an electrical configuration of the sewing machine 1.

An electrical configuration of the sewing machine 1 will be explained with reference to FIG. 16. The sewing machine 1 is provided with the CPU 61 and with a ROM 62, the RAM 63, the flash memory 64, and an input/output interface (I/O) 66, each of which is connected to the CPU 61 by a bus 65.

The CPU 61 performs main control of the sewing machine 1 and, in accordance with various types of programs that are stored in the ROM 62, performs various types of computations and processing that are related to image capture and sewing. The ROM 62 is provided with a plurality of storage areas that include a program storage area, although they are not shown in the drawings. Various types of programs for operating the sewing machine 1 are stored in the program storage area.

Storage areas that store computation results from computational processing by the CPU 61 are provided in the RAM 63 as necessary. Various types of parameters and the like for the sewing machine 1 to perform various types of processing are stored in the flash memory 64. Drive circuits 71 to 74, the touch panel 26, the start/stop switch 29, the image sensor 35, and the detector 36 are connected to the I/O 66. The detector 36 is configured to detect the type of the embroidery frame or the holder member that is mounted on the moving mechanism 40, and to output a detection result.

The sewing machine motor 81 is connected to the drive circuit 71. The drive circuit 71 drives the sewing machine motor 81 in accordance with a control signal from the CPU 61. As the sewing machine motor 81 is driven, the needle bar up-down drive mechanism 34 (refer to FIG. 3) is driven through the drive shaft (not shown in the drawings) of the sewing machine 1, and the needle bar 6 is moved up and down. The X axis motor 83 is connected to the drive circuit 72. The Y axis motor 84 is connected to the drive circuit 73. The drive circuits 72 and 73 respectively drive the X axis motor 83 and the Y axis motor 84 in accordance with control signals from the CPU 61. As the X axis motor 83 and the Y axis motor 84 are driven, the embroidery frame 50 is moved in the left-right direction (the X axis direction) and the front-rear direction (the Y axis direction) by amounts that correspond to the control signals. By driving the LCD 15 in accordance with a control signal from the CPU 61, the drive circuit 74 causes the LCD 15 to display an image.

The operation of the sewing machine 1 will be explained briefly. During embroidery sewing in which the embroidery frame 50 is used, the needle bar up-down drive mechanism 34 (refer to FIG. 3) and the shuttle mechanism (not shown in the drawings) are driven in conjunction with the moving of the embroidery frame 50 in the left-right direction (the X axis direction) and the front-rear direction (the Y axis direction) by the moving mechanism 40. These operations cause an embroidery pattern to be sewn, by the sewing needle 7 that is mounted on the needle bar 6, in the sewing workpiece that is held in the embroidery frame 50. When an ordinary utility pattern that is not an embroidery pattern is sewn, the sewing is performed as the sewing workpiece is moved by the feed dog (not shown in the drawings), in a state in which the moving mechanism 40 has been removed from the bed 11. When an image of an object is captured using any one of the embroidery frame 50, the holder member 120, and the holder member 150, the one of the embroidery frame 50, the holder member 120, and the holder member 150 that is mounted on the moving mechanism 40 is moved in the left-right direction (the X axis direction) and the front-rear direction (the Y axis direction) by the moving mechanism 40. The image sensor 35 captures the image within the image capture range. In this manner, the image data are created for an image that has been captured of the object, the color reference member, and the like that are within the image capture range.

When any one of the embroidery frame 50 on which the holder plate 90 is mounted, the holder member 120, and the holder member 150 has been mounted on the moving mechanism 40 of the sewing machine 1, the sewing machine 1 is able to perform the processing that is hereinafter described. Specifically, because the image sensor 35 of the sewing machine 1 has the AWB, a control portion of the sewing machine 1 is able to adjust the white balance of image data based on the image data that have been captured for the color reference members 93, 123, 153. Because the individual color reference members 93, 123, 153 respectively include the white color reference members 931, 131, 161, the sewing machine 1 is particularly able to adjust the white balance appropriately based on the image data that have been captured for the white color reference members 931, 131, 161. Further, because the image sensor 35 also has the MWB, the sewing machine 1 is able to define the WB values when an image of an object is captured as being the same as the WB values when images are captured of the color reference members 93, 123, 153. Because the image of the object is captured in a state in which the object is disposed along a surface that is planar, the sewing machine 1 is able to acquire image data that describe an image in which deformation of the object that is due to wrinkling, sagging, and the like is reduced.

The sewing machine 1 is able to perform color-related correction on the image data (second image data) for a captured image of an object, based on the image data (first image data) for a captured image of any one of the color reference members 93, 123, 153. For example, based on the first image data, the sewing machine 1 is able to perform known shading correction on the second image data. In that case, the sewing machine 1 is able to acquire the second image data in which uneven coloring and uneven lighting have been reduced from what they were prior to the correction.

An object that is placed on the planar portion 91 can be affixed to the holder plate 90 along the planar surface 911. An object that is placed on the planar portion 121 can be affixed to the holder member 120 along the planar surface 133. The holder member 150 is provided with the planar portion 151, which includes the drawing area 158, in which writing can be done by a writing instrument. The user can use a writing instrument to freely draw an illustration, a figure, a text character, a symbol, and the like in the drawing area 158. The plate 165 is a whiteboard that has been given a surface treatment that makes it possible to do drawing with a writing instrument and erasing with an erasing instrument, so the writing with a writing instrument can be done repeatedly. An object that is placed on the planar portion 151 can be affixed to the holder member 150 along the planar surface 163. With the holder member 150, the user may draw an illustration and the like in the drawing area 158 and may also draw an illustration and the like on the object.

When the embroidery frame 50 with which the holder plate 90 is engaged has been mounted on the sewing machine 1, which is provided with the moving mechanism 40, in a case where one of the holder member 120 and the holder member 150 has been mounted, the sewing machine 1 is capable of performing image processing that is hereinafter described. That is, the sewing machine 1 is able to correct image data (the second image data) that have been created by capturing an image of an object, based on image data (the first image data) that have been created by capturing an image of one of the color reference members 93, 123, 153. The sewing machine 1 is able to appropriately correct uneven coloring in the second image data that is due to image capture conditions such as brightness and the like. In other words, the holder plate 90 and the holder members 120, 150 are more suitable for the creating of the image data by the image sensor 35 of the sewing machine 1 than is the embroidery frame 50, which simply holds the object. The holder plate 90 and the holder members 120, 150 are able to eliminate the burden on the user of preparing a color reference member that is separate from the holder member.

The sewing machine 1 on which the holder member 120 is mounted is able to correct the second image data based on the color information in the image data that have been created for a captured image of the white color reference member 131. The holder member 120 therefore makes it possible for the sewing machine 1 to create the second image data such that the second image data describe the colors of an object more appropriately, particularly white and colors that are close to white. The sewing machine 1 on which the holder member 120 is mounted is able to correct the second image data based on the color information in the image data that have been created for a captured image of the black color reference member 132. The holder member 120 makes it possible for the sewing machine 1 to create the second image data such that the second image data describe the colors of an object more appropriately. These effects can also be achieved by the sewing machine 1 on which the embroidery frame 50 with which the holder plate 90 is engaged has been mounted and by the sewing machine 1 on which the holder member 150 is mounted.

The holder plate 90, with its simple configuration of the magnets 100 and the magnetic bodies 95, makes it possible to affix an object along the planar portion 91, which is planar. The holder member 120, with its simple configuration of the magnets 130 and the magnetic bodies 125, makes it possible to affix an object along the planar portion 121, which is planar. The holder member 150, with its simple configuration of the magnets 160 and the plate 165, makes it possible to affix an object along the planar portion 151, which is planar. Because the holder plate 90 is provided with the indicator portion 97, the user is able to know the positions of the magnetic bodies 95 that are embedded in the planar portion 91, even in a state in which an object has been placed on the surface 911 of the planar portion 91. Therefore, using the magnets 100, the user is easily able to perform the task of affixing the object along the surface 911 of the planar portion 91. Because the holder member 120 is provided with the indicator portion 127, the user is able to know the positions of the magnetic bodies 125 that are embedded in the planar portion 121, even in a state in which an object has been placed on the surface 133 of the planar portion 121. Therefore, using the magnets 130, the user is easily able to perform the task of affixing the object along the surface 133 of the planar portion 121.

The holder plate 90 includes the base line 98. Therefore, using the base line 98 as a reference, the user is able to place an object in an appropriate position on the surface 911 of the planar portion 91. The holder member 120 includes the base line 128. Therefore, using the base line 128 as a reference, the user is able to place an object in an appropriate position on the surface 133 of the planar portion 121. The appropriate position may be, for example, a position in which the object fits within the image capture object range.

When the holder member 120 has been mounted on the sewing machine 1, the color reference member 123 is disposed farther to the front than is the needle bar 6. Therefore, in the process by which the holder member 120 is mounted on the sewing machine 1, the possibility can be reduced that the color reference member 123 will be damaged by coming into contact with the sewing needle 7 that is mounted on the lower end of the needle bar 6 and with the presser foot 9 that is mounted on the lower end of the presser bar 8. The same sort of effect can also be achieved with the holder plate 90. In contrast, when the holder member 150 has been mounted on the sewing machine 1, the color reference member 153 is disposed farther to the rear than is the needle bar 6, and the drawing area 158 is disposed farther to the front than is the needle bar 6. Therefore, after the holder member 150 has been mounted on the sewing machine 1, it is easy for the user to perform the tasks of drawing an illustration or the like in the drawing area 158 with a writing instrument, affixing an object to the drawing area 158, and adjusting the position of an object in the drawing area 158. Furthermore, when the user performs these tasks with the color reference member 153 positioned to the rear of the drawing area 158, the user can avoid touching the color reference member 153, getting the color reference member 153 dirty, and damaging the color reference member 153 by mistake.

The holder member 150 includes the raised portion 154. The raised portion 154 inhibits the inflicting of damage on the color reference member 153 when the holder member 150 is mounted on the sewing machine 1, removed from sewing machine 1 and stored, and the like. In a case where the holder member 150 has been mounted on the sewing machine 1, which is provided with the moving mechanism 40, the holder member 150 is able to inhibit a decrease in the precision of the processing by the sewing machine 1 that corrects the second image data based on the image data that have been created by capturing an image of the color reference member 153.

The holder member 150 includes the sliding sheet 157. If the holder member 150 is compared with a known embroidery frame that has approximately the same outside diameter, the holder member 150 is heavier than the embroidery frame by the weight of the planar portion 151. However, the holder member 150 is provided with the sliding sheet 157 on the back face 164, on the opposite side from the surface 163 of the planar portion 151. Accordingly, when the holder member 150 is mounted on the moving mechanism 40 and the sliding sheet 157 is in contact with the top face of the one of the bed 11 and the needle plate 21 of the sewing machine 1, the holder member 150 is able to move smoothly in a state of low friction resistance.

The holder member of the present disclosure is not limited to the embodiments that are described above, and various types of modifications may be made within the scope of the present disclosure. For example, modifications (A) and (B) described below may be made as desired.

(A) The configuration of the sewing machine 1 on which the holder member is mounted may be modified as desired. The sewing machine 1 may be an industrial sewing machine, and may also be a multi-needle sewing machine.

(B) It is sufficient for the holder plate 90 to be provided with at least the planar portion 91, the engaging portions 92, the color reference member 93, and an affixing portion that is configured to affix an object to the holder plate 90, while other elements of the holder plate 90 may be omitted as desired, and the configuration of the holder plate 90 may be modified. It is sufficient for the holder member 120 to be provided with at least the planar portion 121, the mounting portion 122, the color reference member 123, and an affixing portion that is configured to affix an object to the holder member 120, while other elements of the holder member 120 may be omitted as desired, and the configuration of the holder member 120 may be modified. The sizes, the shapes, and the positions of the planar portions 91, 121 may be modified as desired, taking into consideration the size of the object, the range of movement of the moving mechanism 40, the image capture range of the image sensor 35, and the like. It is sufficient for the engaging portions 92, 99 to be able to engage with an embroidery frame that is held by sewing machine 1, and the shapes, the positions, the number, and the like of the engaging portions 92, 99 may be modified as desired.

The color reference members 93, 123 may each be configured such that they are provided with only one of the white color reference member and the black color reference member. The positions, the sizes, the shapes, and the like of the color reference members 93, 123 may be modified as desired. For example, the color reference members may be provided over the entire image capture object ranges of the planar portions 91, 121. In that case, the first image data may be captured in a state in which the object is not affixed to the planar portions 91, 121, that is, in a state in which the color reference members are exposed to the image sensor 35. The second image data may be captured in a state in which the object is affixed to the planar portions 91, 121, that is, in a state in which the color reference members are not exposed to the image sensor 35.

It is sufficient for an affixing portion to be configured to fix an object in place, and in addition to being at least one set of a magnet and a magnetic body, the affixing portion may also be at least one pair of magnets that are disposed such that they attract one another, and adhesive film, or the like. It is not necessary for the holder member 150 to be provided with the four magnets 160 (refer to FIG. 2). In the holder member 150, the material of the plate 165 may be modified as desired, and the plate 165 may be formed from a magnet, for example. In a case where the plate 165 is formed from a magnet, it is sufficient for the holder member 150 to be a magnetic body, such as an iron plate or the like, instead of being provided with the magnets 160. It is sufficient for the indicators 96, 126 to be provided in at least the perimeters of the planar portions 91, 121, respectively, and to indicate the positions where the magnetic bodies 95, 125 are embedded in the planar portions 91, 121, respectively, and the shapes, the sizes, the positions, the number, and the like of the indicators 96, 126 may be modified as desired, in accordance with the image capture object range and the like. It is sufficient for the base lines 98, 128 to serve as guides for the placing of an object. It is not necessary for the base lines 98, 128 to indicate the image capture object range that is set by the sewing machine 1. The indicators and the base lines may also be printed marks or raised portions, for example. In the holder member 150, the sliding sheet 157 may be omitted as desired. The holder member 120 may also be provided with the sliding sheet 157 in the same manner as the holder member 150. In the holder member 150, the raised portion 154 may be omitted as desired. The holder plate 90 and the holder member 120 may also be provided with the raised portion 154 in the same manner as the holder member 150. The raised portion 154 may also be provided in at least a portion of the area around any one of the color reference members 93, 123, 153.

What is claimed is:

1. A rectangular holder member, comprising:

a planar portion that has a surface that is planar and is rectangular;

a mounting portion that is provided in a longitudinal side of a perimeter portion of the planar portion, that extends in a longitudinal direction of the planar portion, that supports the planar portion, and that is configured to be removably mounted on an embroidery frame moving mechanism of a sewing machine;

a plurality of base lines that are straight line segments provided on the planar portion;

a color reference member that is rectangular, that is located in a position which is outside of a range bounded by the base lines on the planar portion in the longitudinal direction of the planar portion, and that shows a color that serves as a reference, a longitudinal side of the color reference member being orthogonal to the longitudinal side of the planar portion; and an affixing device that:

is configured to fix in place an object that has been placed on the planar portion; and includes a plurality of magnets and a plurality of magnetic bodies, each of the magnetic bodies being embedded in the planar portion and provided on one of the base lines.

2. The rectangular holder member according to claim 1, wherein the color reference member includes a rectangular white color reference member that serves as a reference for the color white, and a longitudinal direction of the white color reference member is orthogonal to the longitudinal side of the planar portion.

3. The rectangular holder member according to claim 1, wherein the color reference member includes a rectangular black color reference member that serves as a reference for the color black, and a longitudinal direction of the black color reference member is orthogonal to the longitudinal side of the planar portion.

4. The rectangular holder member according to claim 1, wherein the affixing device is provided on the planar portion, and the rectangular holder member further comprises an indicator portion that is provided in at least a perimeter portion of the planar portion and that includes an indicator that indicates a position where the affixing device is provided on the planar portion.

5. A rectangular holder member, comprising:

a planar portion that has a surface that is planar and is rectangular;

an engaging portion that is provided in the planar portion and that is capable of engaging with an embroidery frame that a sewing machine holds;

a plurality of base lines that are straight line segments provided on the planar portion;

a color reference member that is rectangular, that is located in a position which is outside of a range bounded by the base lines on the planar portion in the longitudinal direction of the planar portion, and that shows a color that serves as a reference, a longitudinal side of the color reference member being orthogonal to the longitudinal side of the planar portion; and an affixing device that:

is configured to fix in place an object that has been placed on the planar portion; and includes a plurality of magnets and a plurality of magnetic bodies, each of the magnetic bodies being embedded in the planar portion and provided on one of the base lines.

6. The rectangular holder member according to claim 5, wherein the color reference member includes a rectangular white color reference member that serves as a reference for the color white, and a longitudinal direction of the white color reference member is orthogonal to the longitudinal side of the planar portion.

7. The rectangular holder member according to claim 5, wherein the color reference member includes a rectangular black color reference member that serves as a reference for the color black, and a longitudinal direction of the black color reference member is orthogonal to the longitudinal side of the planar portion.

8. The rectangular holder member according to claim 5, further comprising, an indicator portion that is provided in at least a perimeter portion of the planar portion and that includes an indicator that indicates a position where each magnetic body is embedded in the planar portion.

9. A rectangular holder member, comprising:

a planar portion that has a surface that is planar and is rectangular;

a plate that is rectangular, that is made of a magnetic material, and that is provided on the planar portion;

a mounting portion that is provided in one longitudinal side of a perimeter portion of the planar portion, that extends in a longitudinal direction of the planar portion, that supports the planar portion, and that is configured to be removably mounted on an embroidery frame moving mechanism of a sewing machine; and a color reference member that is rectangular, that is located in a position on the planar portion where the plate is not provided, that is located relative to the plate in the longitudinal direction of the planar portion, and that shows a color that serves as a reference, a longitudinal side of the color reference member being orthogonal to the longitudinal side of the planar portion, a length of the longitudinal direction of the color reference member being equal to a length of a transverse direction of the plate.

10. The rectangular holder member according to claim 9, further comprising:

a magnet that, together with the plate, fixes in place an object that has been placed on the planar portion.

11. The rectangular holder member according to claim 9, wherein the color reference member includes a rectangular white color reference member that serves as a reference for the color white, and a longitudinal direction of the white color reference member is orthogonal to the longitudinal side of the planar portion.

12. The rectangular holder member according to claim 9, wherein the color reference member includes a rectangular black color reference member that serves as a reference for the color black, and a longitudinal direction of the black color reference member is orthogonal to the longitudinal side of the planar portion.

13. The rectangular holder member according to claim 9, further comprising:

a raised portion that is provided in the planar portion and that protrudes higher than the surface of the color reference member in at least a portion of the perimeter of the color reference member.

14. The rectangular holder member according to claim 9, further comprising:

a sliding sheet that is provided on a face of the planar portion on the opposite side from the surface of the planar portion , and that is provided at an edge of one longitudinal side of the planar portion opposite to another longitudinal side of the planar portion with the mounting portion, wherein a coefficient of friction of the sliding sheet is lower than a coefficient of friction of the planar portion.

15. The rectangular holder member according to claim 9, wherein the plate has been given a surface treatment that enables at least one of drawing by a writing instrument and erasing by an erasing instrument in the drawing area.

* * * * *